US010292506B2

(12) United States Patent
Matus, Jr.

(10) Patent No.: US 10,292,506 B2
(45) Date of Patent: May 21, 2019

(54) MODULAR FOOD GUARD SYSTEM

(71) Applicant: Jose Orlando Matus, Jr., Gainesville, GA (US)

(72) Inventor: Jose Orlando Matus, Jr., Gainesville, GA (US)

( * ) Notice: Subject to any disclaimer, the term of this patent is extended or adjusted under 35 U.S.C. 154(b) by 0 days.

(21) Appl. No.: 14/488,425

(22) Filed: Sep. 17, 2014

(65) Prior Publication Data

US 2016/0073795 A1 Mar. 17, 2016

(51) Int. Cl.
*A47F 10/06* (2006.01)

(52) U.S. Cl.
CPC ..... *A47F 10/06* (2013.01); *A47F 2010/065* (2013.01)

(58) Field of Classification Search
CPC ..... A47F 3/12; A47F 3/007; A47F 7/0071; A47F 9/00; A47F 10/06; A47F 2010/065
USPC ..... 403/362, 109.4; 248/218.4, 222.14, 248/354.3, 354.4
See application file for complete search history.

(56) References Cited

U.S. PATENT DOCUMENTS 2,689,483 A * 9/1954 Senna ..... B21D 7/02 192/93 R
2,874,984 A * 2/1959 Bernard ..... A47F 3/12 403/173
3,157,378 A * 11/1964 Blum ..... E04F 11/1836 248/218.4
3,513,606 A * 5/1970 Jones ..... A47B 47/0016 211/182
3,955,800 A * 5/1976 Russo ..... E04F 11/181 256/59
4,036,371 A * 7/1977 Michel ..... A47B 47/021 211/182
4,326,352 A * 4/1982 Barth ..... E01F 9/623 248/156
4,490,064 A * 12/1984 Ducharme ..... A47B 47/0008 403/252
5,371,988 A * 12/1994 Hannes ..... B21C 35/026 403/174
5,690,239 A * 11/1997 Ballard ..... A47F 5/04 211/187
6,132,018 A * 10/2000 McGrath ..... A47F 3/007 248/398

(Continued)

*Primary Examiner* — Andrew M Roersma
(74) *Attorney, Agent, or Firm* — Smith Tempel Blaha, LLC; Matthew T. Hoots

(57) ABSTRACT

Various embodiments of a modular food shield system are disclosed and described within the context of exemplary food shield configurations. Certain embodiments may include cut-to-length support posts. Further, certain embodiments may include versatile brackets that can be positioned, and repositioned, along the length of support post without requiring that the support post be slotted, tapped, drilled or otherwise customized to secure the bracket in position. Brackets used in certain embodiments may further be configured to make use of one or more "double duty" set screws that can simultaneously secure the bracket to a support post while providing a structure for mating with one or more ancillary components in the food shield system such as, but not limited to, an internally threaded barrel spacer, a cut-to-length support post, a main viewing panel or side panel, a finishing cap component, a viewing panel adjustment mechanism, etc.

35 Claims, 20 Drawing Sheets

(56) References Cited

U.S. PATENT DOCUMENTS

| | | | | |
|---|---|---|---|---|
| 6,467,756 | B1 * | 10/2002 | Elsasser | E04H 12/2215 248/156 |
| 6,581,896 | B1 * | 6/2003 | Olexovitch | A47G 7/044 248/222.14 |
| 6,588,863 | B1 * | 7/2003 | Yatchak | A47B 3/0803 108/147.11 |
| D625,984 | S * | 10/2010 | McGrath | D8/355 |
| 8,109,579 | B2 * | 2/2012 | English | A47B 96/062 211/150 |
| 8,196,872 | B1 * | 6/2012 | McGrath | F16B 9/023 248/346.01 |
| 8,302,919 | B1 * | 11/2012 | McGrath | F16M 11/10 248/121 |
| 8,308,249 | B2 * | 11/2012 | Matus, Jr. | A47F 3/007 312/137 |
| 8,403,430 | B2 * | 3/2013 | Atkins | A47F 10/06 248/122.1 |
| 8,615,964 | B1 * | 12/2013 | Poma | E04F 11/1812 256/59 |
| 8,936,223 | B1 * | 1/2015 | McGrath | A47K 1/00 248/205.1 |
| 9,010,883 | B2 * | 4/2015 | Scott | A47F 10/06 312/137 |
| 9,144,329 | B1 * | 9/2015 | McGrath | A47F 3/12 |
| 2003/0152419 | A1 * | 8/2003 | Wang | F16B 7/1418 403/109.4 |
| 2006/0163976 | A1 * | 7/2006 | Matus | A47F 10/06 312/140.4 |
| 2007/0236112 | A1 * | 10/2007 | Williman | A47F 3/12 312/140.4 |
| 2011/0169384 | A1 * | 7/2011 | Padden | A47F 10/06 312/140.4 |

* cited by examiner

MODULAR FOOD GUARD SYSTEM

BACKGROUND

Food shield systems, sometimes referred to as food guards or "sneeze guards," are required by federal law for any attendant-served or self-service food establishment. Food shield systems reside in what is termed the "splash zone" and must be designed and constructed according to standards developed by the National Sanitation Foundation ("NSF"). At a high level of NSF standards, a food shield installation is required to have a front glass panel, often referred to as a main viewing panel, that provides a barrier between the consumer and food that may be either directly accessed by the consumer, i.e., self service, or served to the consumer by an attendant, i.e., attendant-served, such as in a cafeteria. Therefore, in general, there are two types of food shield installations, namely, a self-service type of food shield designed to allow consumers to serve themselves (buffet) and an attendant-served type of food shield designed to allow an attendant to serve consumers (cafeteria). With food shield installations of the self-service type, an opening exists between the lower edge of the main viewing panel and the countertop to allow consumers to access food through the opening. With food shield installations of the attendant-serve type, the main viewing panel extends over most or all of the vertical distance between the top panel of the food shield and the countertop to eliminate the aforementioned opening. In other words, in an attendant-served food shield installation, the main viewing panel separates the consumers from the food and an attendant who is located on the opposite side of the food shield system from the consumer.

As even a casual observer of food shield installations will notice, self-service food shield, attendant-served food shield, and combination food shield installations all vary greatly in configuration according to their specific application. Some food shield installations may be designed to make a "turn" along a food area with one or more corners, for instance. Other food shield installations may be installed as one straight "run," but with multiple sections, while still others may be suspended over a food area, and so forth. To further expand the seemingly endless configurations for food shield installations, many applications require on-site modification of a food shield system at the time of or after its installation. The many different configurations that may be required in the marketplace of food shield systems, along with the reality that any given specific application of a food shield system may necessitate on-site modification at the time of or after installation, makes it difficult for a designer of a food shield system to ensure that each and every installation is not only efficiently constructed, but also results in an installed system that meets the NSF requirements.

Therefore, there is a need in the art for a modular food shield system that includes versatile components that may be used in various combinations to efficiently construct, adjust, and modify a food shield installation on-site. Moreover, there is a need in the art for a modular food shield system for on-site construction, adjustment and modification that consistently meets NSF requirements.

BRIEF SUMMARY

Various embodiments of a modular food shield system are disclosed and described within the context of exemplary food shield configurations. Certain embodiments of a modular food shield system may include cut-to-length support posts having an inner structure configured to receive a top cap or fastener regardless of to what length the support post may have been cut. Further, certain embodiments of a modular food shield system may include versatile brackets that may be positioned, and repositioned, along the length of support post without requiring that the support post be slotted, tapped, drilled or otherwise customized to secure the bracket in position. Brackets used in certain embodiments may further be configured to make use of one or more "double duty" set screws that may simultaneously secure the bracket to a support post while providing a structure for mating with one or more ancillary components in the food shield system such as, but not limited to, an internally threaded barrel spacer, a cut-to-length support post, a main viewing panel or side panel, a finishing cap component, a viewing panel adjustment mechanism, etc.

Versatile brackets in certain embodiments of a modular food shield system may also feature curved surfaces that may be exposed to splashed food while providing a flat surface to which an ancillary component may mate via a double duty set screw. By providing a flat mating surface, which will not be exposed to splashed food once a complimentary component is mechanically mated, a versatile bracket may provide for very tight manufacturing tolerances that avoid any open seams, recesses or unnecessary projections that may result from mating components. Similarly, cut-to-length support posts, which may be extruded such that an internal structure generates a certain cross-sectional profile regardless of where along the post's length it is cut, may be extruded to very tight standards. The result of components that are designed to be manufactured at tight tolerances is that an installed food shield according to an embodiment of a modular food shield system may exhibit gaps between mating components that are 0.015 inches or less.

An exemplary modular food shield system comprises a support post having an upper end, a lower end and an outer surface defining a length between the upper end and lower end. The outer surface of the support post may be free of drilled holes. Two or more brackets may be adjustably mounted to the support post, with a viewing panel mounted to at least one of the two or more brackets and an ancillary component mounted to each of the two or more brackets. Each of the one or more brackets may comprise a double duty set screw configured to fix the position of its associated bracket on the support post and receive an ancillary component such that the double duty set screw is concealed from exposure to food splatter or other airborne contaminants.

These and other features and advantages of the solution will become apparent from the following description, drawings and claims.

DETAILED DESCRIPTION

Figure 1A:
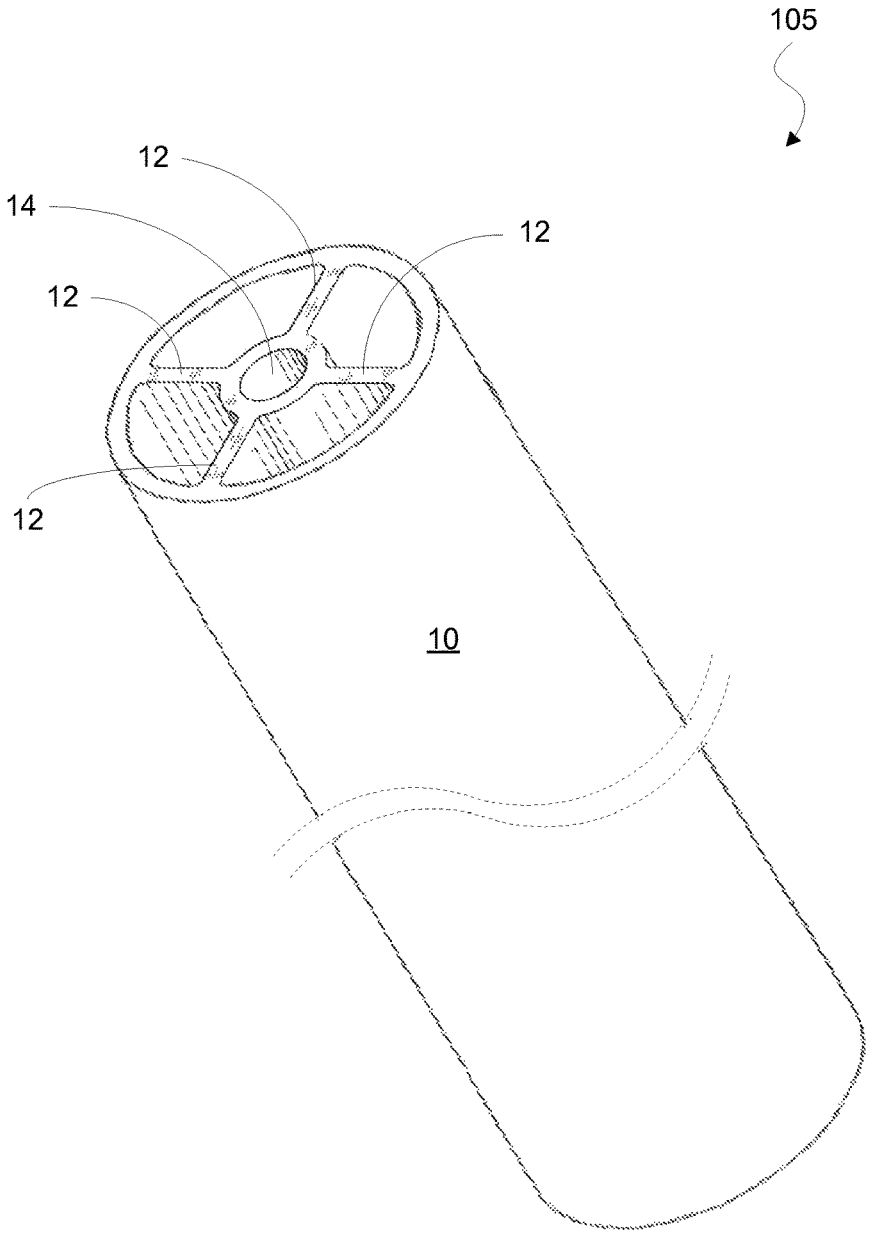
FIG. 1A is a perspective view of an exemplary cut-to-length support post that may be included in a modular food shield system.

The presently disclosed embodiments, as well as features and aspects thereof, are directed towards a modular food shield system with versatile components. Advantageously, embodiments of a modular food shield system may provide for on-site design and installation of almost any food shield installation, whether the installation is an attendant-served installation, a self-serve installation, a combination installation or a custom installation. Further, embodiments of a modular food shield system may be installed on-site to conform to NSF requirements. Moreover, it is an advantage of certain embodiments of a modular food shield system that components in a particular installation may be modified, rearranged or adjusted without compromising the installation's ability to conform to NSF requirements.

At a specific level of the NSF requirements, components used to construct a food shield installation must be designed and manufactured such that when assembled to form an installed system, the harborage of vermin and the accumulation of dirt, dust and debris are prevented. Moreover, a food shield installation must allow for the inspection, maintenance, servicing, and cleaning of the overall food shield and its individual components. For example, according to NSF standards, splash zone surfaces shall be accessible and easily cleanable and permanent joints and seams exposed to the splash zone shall be sealed and smooth. Components of a food shield system shall be smooth, easily cleanable and corrosion resistant when installed and without having any open seams, recesses or unnecessary projections.

Further according to NSF requirements at the time of this writing, any fasteners used in a food shield installation shall not be used in the food zone. The NSF requirements further dictate that fasteners shall be easily cleanable and that fasteners meeting the "easily cleanable" standard include, but are not limited to, slot-head and Phillips-head screws, hex head fasteners, and flush-break pop rivets. Hex key screws and non flush-break pop rivets may be used in a splash zone or a nonfood zone provided that the heads are capped (i.e., covered with another component) or filled (i.e., with a silicone substance, for example).

Further regarding fastener requirements per NSF guidelines, fasteners used in a food shield installation shall be tight fitting to a surface and, if a washer is used in conjunction with a fastener, no more than one locking washer and one flat washer may be used. The diameter of a washer adjacent to a fastening surface shall not be less than the diameter of a washer under the fastener head (so as not to create a crevice in which splashed food may get captured). Similarly, NSF guidelines proscribe the use of external-tooth lock washers which, when used, introduce small crevices into which splashed food may get lodged.

Even further regarding fasteners, once installed in a food shield installation, the NSF guidelines dictate that there shall be no exposed threads, projecting screws, or studs in a food or splash zone. Even in nonfood zones, there shall be no more than 2.5 exposed threads or ¼ inch of exposed threads, whichever is less, on a fastener that is a part of an installed food shield. Moreover, the sharp point of a fastener may not be exposed in an installed food shield.

As would be understood by one of ordinary skill in the art, the stringent requirements for a finished food shield make it a challenge for designers of food shield systems to develop a system that is "fool proof" and flexible in its installation on-site. The reality of a typical food shield application is that modifications are inevitably necessary as on-site dimensions differ from the expected, change orders are issued by clients, project layouts change, etc. For many food shield systems known in the art, even a slight change in the expected application for a particular installation may necessitate that new and different components be used, certain components be scrapped or modified, etc., thereby resulting in costly redesigns, wasted components and extended lead times. For food shield systems known in the art, simple modification of the components to accommodate any on-site changes may render the resulting installation non-compliant with the NSF standard.

Advantageously, embodiments of a modular food shield system described herein provide an installer with flexibility to make on-site modifications to a food shield installation without compromising compliance with the NSF standard. For example, certain embodiments of a modular food shield system may include cut-to-length support posts having an inner structure configured to receive a top cap or fastener regardless of to what length the support post may have been cut. Further, certain embodiments of a modular food shield system may include versatile brackets that can be positioned, and repositioned, along the length of support post without requiring that the support post be slotted, tapped, drilled or otherwise customized to secure the bracket in position. Brackets used in certain embodiments may further be configured to make use of one or more "double duty" set screws that can simultaneously secure the bracket to a support post while providing a structure for mating with one or more ancillary components in the food shield system such as, but not limited to, an internally threaded barrel spacer, a cut-to-length support post, a main viewing panel or side panel, a finishing cap component, a viewing panel adjustment mechanism, etc.

Versatile brackets in certain embodiments of a modular food shield system may also feature curved surfaces that may be exposed to splashed food while providing a flat surface to which an ancillary component may mate via a double duty set screw. By providing a flat mating surface, which will not be exposed to splashed food once a complimentary component is mechanically mated, a versatile bracket may provide for very tight manufacturing tolerances that avoid any open seams, recesses or unnecessary projections that may result from mating components. Similarly, cut-to-length support posts, which may be extruded such that an internal structure generates a certain cross-sectional profile regardless of where along the post's length it is cut, may be extruded to very tight standards. The result of components that are designed to be manufactured at tight tolerances is that an installed food shield according to an embodiment of a modular food shield system may exhibit gaps between mating components that are 0.015 inches or less.

It is envisioned that versatile brackets used in a modular food shield system may be unidirectional, bidirectional or multidirectional in form such that, when positioned and attached to a support post, ancillary components of the food shield may be mounted off one side, both sides or multiple sides of the bracket, as the case may be. As will become apparent from a review of the drawings and related description, it is an advantage of modular food shield systems that a single bracket, such as a unidirectional bracket for example, may be mounted at any point along and around the circumference of a support post without the need for the support post to be tapped or drilled. As such, with a single bracket, the position of ancillary components mounted to the bracket may be adjusted and fine tuned on-site without having to compromise the outer surface of the support post. In this way, a multitude of food shield configurations may be installed using only a few versatile bracket configurations, as each versatile bracket may be flexibly applied in the installation. Moreover, in this way, adjusting a bracket from one position on a support post to another position on the support post will not expose a tapped or drilled hole in the support post that would render the installation non-compliant with the NSF standard.

In this description, use of the word "versatile" in association with a component, such as a versatile bracket, means that the particular component may be employed in myriad applications in a food shield installation and, by design, is not limited to one specific application. By contrast, versatile is not meant to suggest that a certain component may be used in all applications for that type of component. Moreover, and as one of ordinary skill in the art will recognize after review of the figures and the related descriptions, a particular versatile bracket used in a modular food shield system may be unidirectional, bidirectional or multidirectional in form. A unidirectional bracket, for example, may be configured to receive ancillary components on one side of a support post to which it is mounted. Similarly, a bidirectional bracket may be configured to receive ancillary components on two sides of a support post to which it is mounted.

In this description, the term "accessible" is used consistently with its NSF definition to mean manufactured to be exposed for cleaning and inspection with the use of simple tools.

In this description, the term "easily cleanable" is used consistently with its NSF definition to mean manufactured so that food and other soiling material may be removed by manual cleaning methods.

In this description, the term "manual cleaning" is used consistently with its NSF definition to mean cleaning by hand with appropriate cleaning tools.

In this description, the term "sealed" is used consistently with its NSF definition to mean manufactured without openings, to prevent entry or leakage of liquid or moisture.

In this description, the term "simple tools" is used consistently with its NSF definition to mean hand tools commonly available to food establishment maintenance and cleaning personnel, such as screwdrivers, pliers, open-ended wrenches, and Allen wrenches.

In this description, the term "smooth" is used consistently with its NSF definition to mean free of pits, pinholes, cracks, crevices, inclusions, rough edges, and other surface imperfections detectable by visual and tactile inspection.

In this description, reference to the NSF standard is not meant to limit the scope of the solution to a modular food shield system that specifically meets the NSF standard in place at the time of this writing. Although certain embodiments of the solution may, in fact, be designed, manufactured, configured and installed to meet the NSF standard as it presently exists, it is envisioned that certain other embodiments of the solution may be designed, manufactured, configured and installed in accordance with a revised NSF standard and/or some other promulgated standard.

Turning now to the figures, where like labels represent like elements throughout the drawings, various aspects, features and embodiments of a modular food shield system will be presented in more detail. The examples as set forth in the drawings and detailed description are provided by way of explanation and are not meant as limitations on the scope of a modular food shield system. A modular food shield system thus includes any modifications and variations of the following examples as come within the scope of the appended claims and their equivalents.

FIG. 1A is a perspective view of an exemplary cut-to-length support post 105 that may be included in a modular food shield system. Notably, the exemplary support post 105 is depicted as being cylindrical in form, i.e., as having a generally round cross-section; however, support posts having cross-sectional profiles other than a circular profile are envisioned. For example, it is envisioned that certain support posts included in particular embodiments of a modular food shield system may feature cross-sectional profiles that are square, pentagonal, hexagonal, octagonal, oval, etc.

Returning to the exemplary support post 105 in the FIG. 1A illustration, the outer surface 10 may be smooth. Further, an inner structure may include a plurality of spoke elements 12 extending from the outer diameter of the support post 105 to a centrally located hub element 14 for anchoring a fastener (not shown in the FIG. 1A illustration). Notably, although the exemplary support post 105 is depicted as having four spoke elements 12, it is envisioned that other embodiments of a cut-to-length support post may have fewer than, or more than, four spoke elements. Similarly, although the exemplary support post 105 is depicted as having a round hub element 14, it is envisioned that other embodiments of a cut-to-length support post may have a hub element with a different cross-sectional profile such as, for example, a square, pentagonal, hexagonal or octagonal cross-sectional profile.

An advantage of a cut-to-length support post 105 is that it may be cut on-site to a required length when installing a food shield. In this way, embodiments of a modular food shield system avoid having to pre-cut support posts off-site. Further, because the support post 105 includes the spoke 12 and hub 14 center profile, a support post 105 is ready to be prepared for mechanically receiving a fastener component or some other component. Notably, while a solid bar known in the art may be cut-to-length on-site and used as a support post, a solid bar would still need to be drilled and tapped on its end in order to be ready to receive a fastener component. Certain embodiments of a cut-to-length support post 105 may be extruded in manufacture.

Figure 1B:
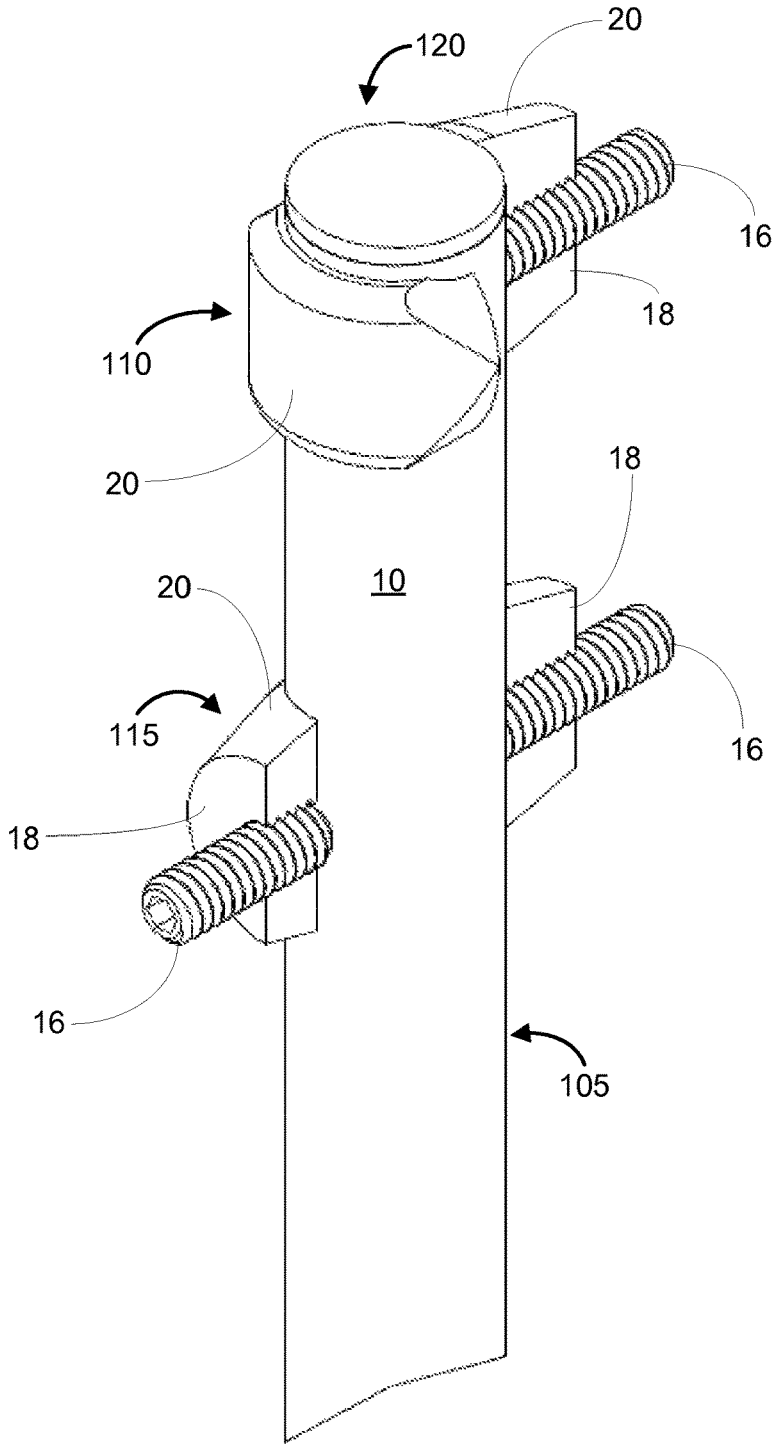
FIG. 1B depicts a cutaway view of an exemplary unidirectional bracket and an exemplary bidirectional bracket mounted to a support post cut from the cut-to-length support post of FIG. 1A.

FIG. 1B depicts a cutaway view of an exemplary unidirectional bracket 110 and an exemplary bidirectional bracket 115 mounted to a support post 105 cut from the cut-to-length support post of FIG. 1A. It can be understood from the FIG. 1B illustration that cap component 120 has been mechanically mated with the top of the support post 105 such that a portion of the cap component 120 is anchored in the hub feature 14 described in FIG. 1A.

The unidirectional bracket 110 is versatile in that it may be positioned at substantially any height on the support post 105. Similarly, the unidirectional bracket 110 is versatile in that it may be positioned at substantially any point circumferentially on the support post 105. Advantageously, therefore, the unidirectional bracket 110 may be oriented such that the flat mating surface 18 faces radially outward from the support post 105 in any direction.

To fix the unidirectional bracket 110 in a position on the support post 105, the double duty set screw 16 may be tightened down through the unidirectional bracket 110 and onto the outer surface of the support post 105, as would be understood by one of ordinary skill in the art. Advantageously, therefore, the support post 105 does not require that a hole be tapped or drilled through its smooth outer surface 10 in order for the unidirectional bracket 110 to be fixed in a position on the support post 105. As such, and as one of ordinary skill in the art would recognize, the unidirectional bracket 110 may be relocated from a first fixed position on the support post 105 to a second fixed position on the support post 105 without compromising the surface integrity of the support post 105 at the first position or otherwise exposing a void in which food splatter may ingress.

Similar to the unidirectional bracket 110, the bidirectional bracket 115 is versatile in that it may be positioned at substantially any height on the support post 105. Similarly, the bidirectional bracket 115 is versatile in that it may be positioned at substantially any point circumferentially on the support post 105. Advantageously, therefore, the bidirectional bracket 115 may be oriented such that the opposing flat mating surfaces 18 face radially outward from the support post 105 in any direction.

To fix the bidirectional bracket 115 in a position on the support post 105, one or both of the double duty set screws 16 may be tightened down through the bidirectional bracket 115 and onto the outer surface of the support post 105, as would be understood by one of ordinary skill in the art. Advantageously, therefore, the support post 105 does not require that a hole be tapped or drilled through its smooth outer surface 10 in order for the bidirectional bracket 115 to be fixed in a position on the support post 105. As such, and as one of ordinary skill in the art would recognize, the bidirectional bracket 110 may be relocated from a first fixed position on the support post 105 to a second fixed position on the support post 105 without compromising the surface integrity of the support post 105 at the first position or otherwise exposing a void in which food splatter may ingress.

Although the bidirectional bracket 115 is depicted such that the opposing flat mating surfaces 18 are one hundred eighty degrees apart, it is envisioned that other bidirectional bracket embodiments and/or multidirectional bracket embodiments may be configured such that the flat mating surfaces face in directions that are less than one hundred eighty degrees apart. Also, as can be seen in the FIG. 1B illustration, the double duty set screws 16 extend beyond the flat mating surfaces 18 of the brackets 110, 115 such that they provide a means for an ancillary component (not shown in the FIG. 1B illustration) to be mounted flush to the surface 18. In this way, one of ordinary skill in the art will recognize that it is an advantage of brackets 110, 115 that an ancillary component may be mounted such that the double duty set screw 16 is contained within the bracket 110, 115 and ancillary component and not exposed to splashed food. Additionally, versatile brackets such as brackets 110, 115 may exhibit outer contours 20 that are "rounded" or curved, as opposed to having rectilinear contours formed from intersecting planes of flat surfaces, so that the brackets are easily cleanable.

Figure 1C:
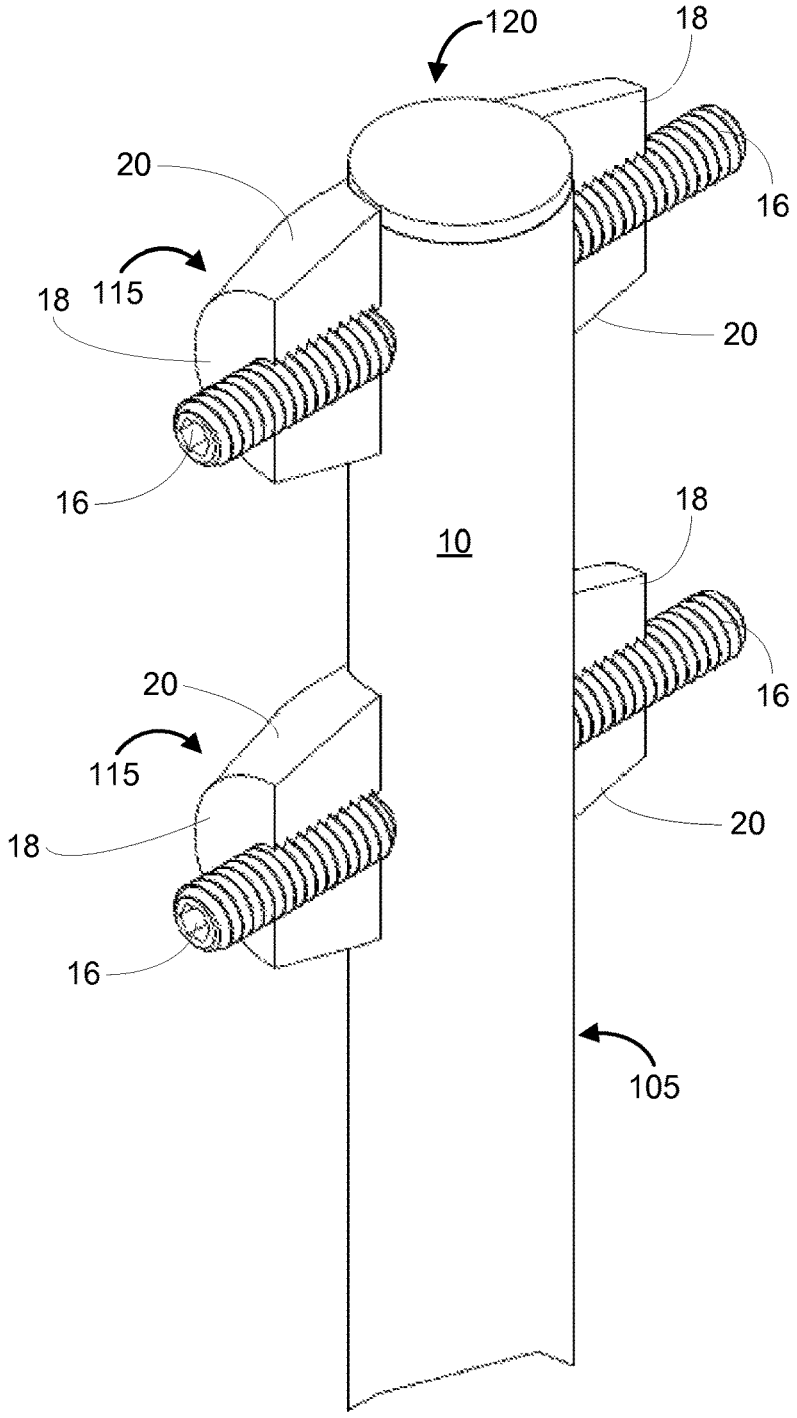
FIG. 1C depicts a cutaway view of a pair of exemplary bidirectional brackets mounted to a support post cut from the cut-to-length support post of FIG. 1A.

FIG. 1C depicts a cutaway view of a pair of exemplary bidirectional brackets 115 mounted to a support post 105 cut from the cut-to-length support post of FIG. 1A. Portions of the description above relative to the FIG. 1B illustration are applicable to the FIG. 1C illustration. As will be seen in subsequent figures, arrangements of multiple bidirectional brackets 115 on a support post 105, such as that depicted in FIG. 1C, may provide a support structure for a modular food shield system configuration. Notably, it is envisioned that any number of versatile brackets may be mounted on a given support post 105 as may be required for a particular modular food shield configuration.

Figure 1D:
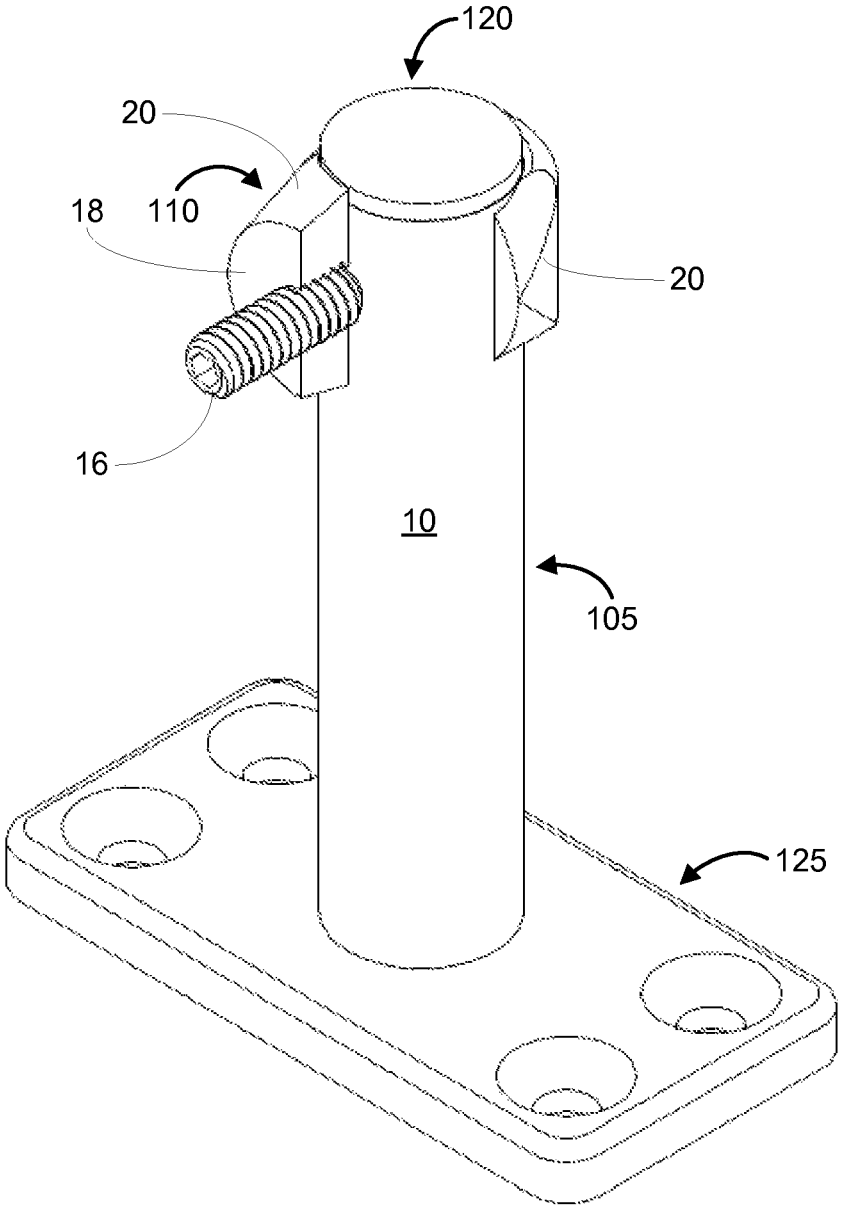
FIG. 1D depicts a cutaway view of a an exemplary unidirectional bracket mounted to a support post cut from the cut-to-length support post of FIG. 1A, the support post shown with a top cap component and mounted to an exemplary support base.

FIG. 1D depicts a cutaway view of an exemplary unidirectional bracket 110 mounted to a support post 105 cut from the cut-to-length support post of FIG. 1A, the support post 105 shown mounted to an exemplary support base 125 and with a top cap component 120 received into the hub feature 14. The support base 125 is shown in a rectangular form, however, it is envisioned that a support base 125 may take the form of essentially any shape that would occur to one of ordinary skill in the art. As would be further apparent to one of ordinary skill in the art, the support base 125 may be mounted to a surface such that a modular food shield installation that includes the support post 105 is positioned over a splash zone. Portions of the description above relative to the FIG. 1B illustration are applicable to the FIG. 1D illustration. As will be seen in subsequent figures, arrangements of unidirectional brackets 110 on a support post 105, such as that depicted in FIG. 1D, may provide a support structure for a modular food shield system configuration. Again, it is envisioned that any number of versatile brackets may be mounted on a given support post 105 as may be required for a particular modular food shield configuration.

Figure 1E:
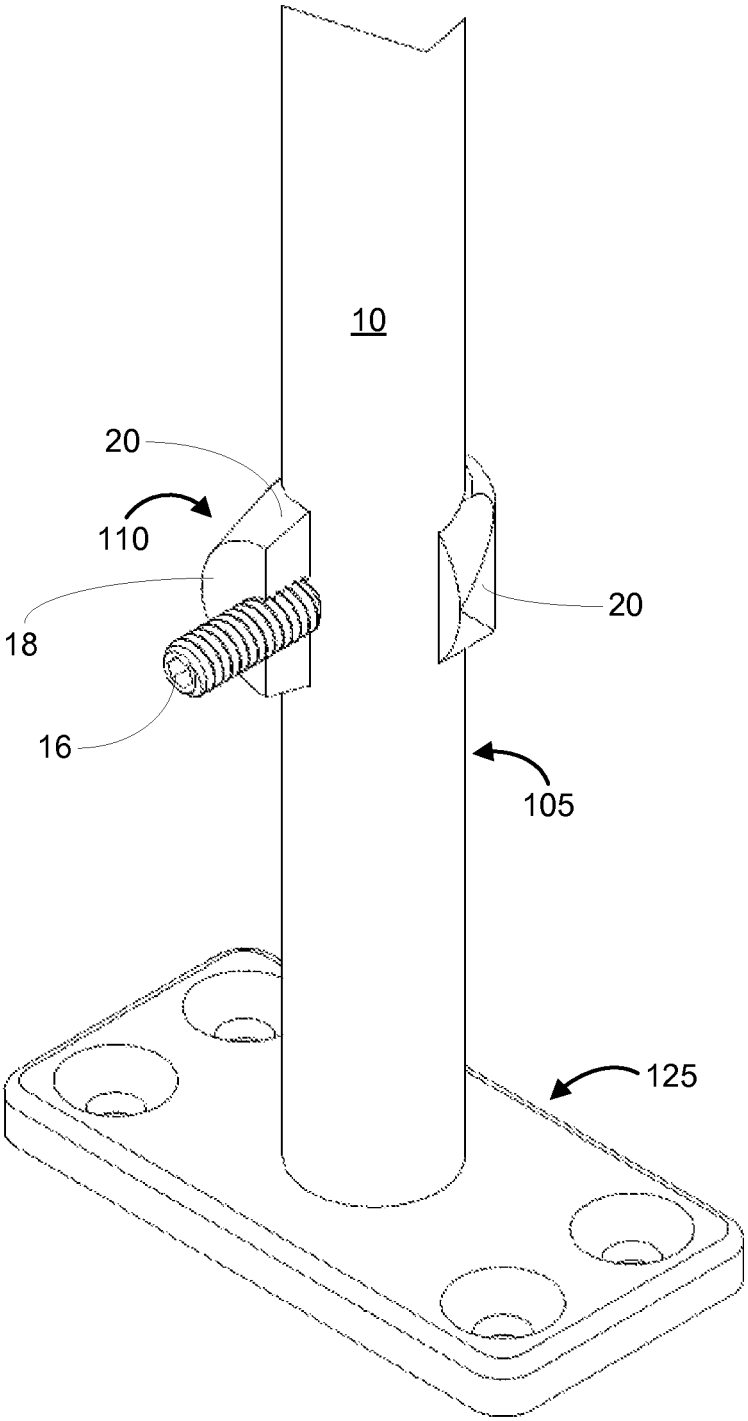
FIG. 1E depicts a cutaway view of a an exemplary unidirectional bracket mounted to a support post cut from the cut-to-length support post of FIG. 1A, the support post shown mounted to an exemplary support base.

FIG. 1E depicts a cutaway view of an exemplary unidirectional bracket 110 mounted to a support post 105 cut from the cut-to-length support post of FIG. 1A, the support post 105 shown mounted to an exemplary support base 125. Comparing the FIG. 1E illustration to the FIG. 1D illustration, one of ordinary skill in the art will understand that the unidirectional bracket 110 (as well as bidirectional bracket 115) may be positioned substantially anywhere along the length of a support post 105 and at any orientation circumferentially. Again, the support base 125 may be mounted to a surface such that a modular food shield installation that includes the support post 105 is positioned over a splash zone. Portions of the description above relative to the FIG. 1B illustration are applicable to the FIG. 1E illustration. As will be seen in subsequent figures, arrangements of unidirectional brackets 110 on a support post 105, such as that depicted in FIG. 1E, may provide a support structure for a modular food shield system configuration.

Notably, and as can be seen in a comparison of the exemplary unidirectional and bidirectional brackets 110, 115 depicted in FIGS. 1B through 1E, it is an aspect of certain modular food shield systems that the lengths of the brackets 110, 115 may vary. For example, when comparing the unidirectional bracket 110 from FIG. 1B with the unidirectional bracket 110 from FIG. 1D, it can be seen that the flat mating surfaces 18 vary in distance from the outer surfaces 10 of their respective support posts 105. It is envisioned that by providing brackets 110, 115 with varying overall lengths, embodiments of a modular food shield may position certain viewing panels and/or ancillary accessories relatively close or far away, as the application may dictate, from a support post 105. In this way, for example, a viewing panel may be fixed relatively close to a support post as compared to another component in the system.

Figure 2A:
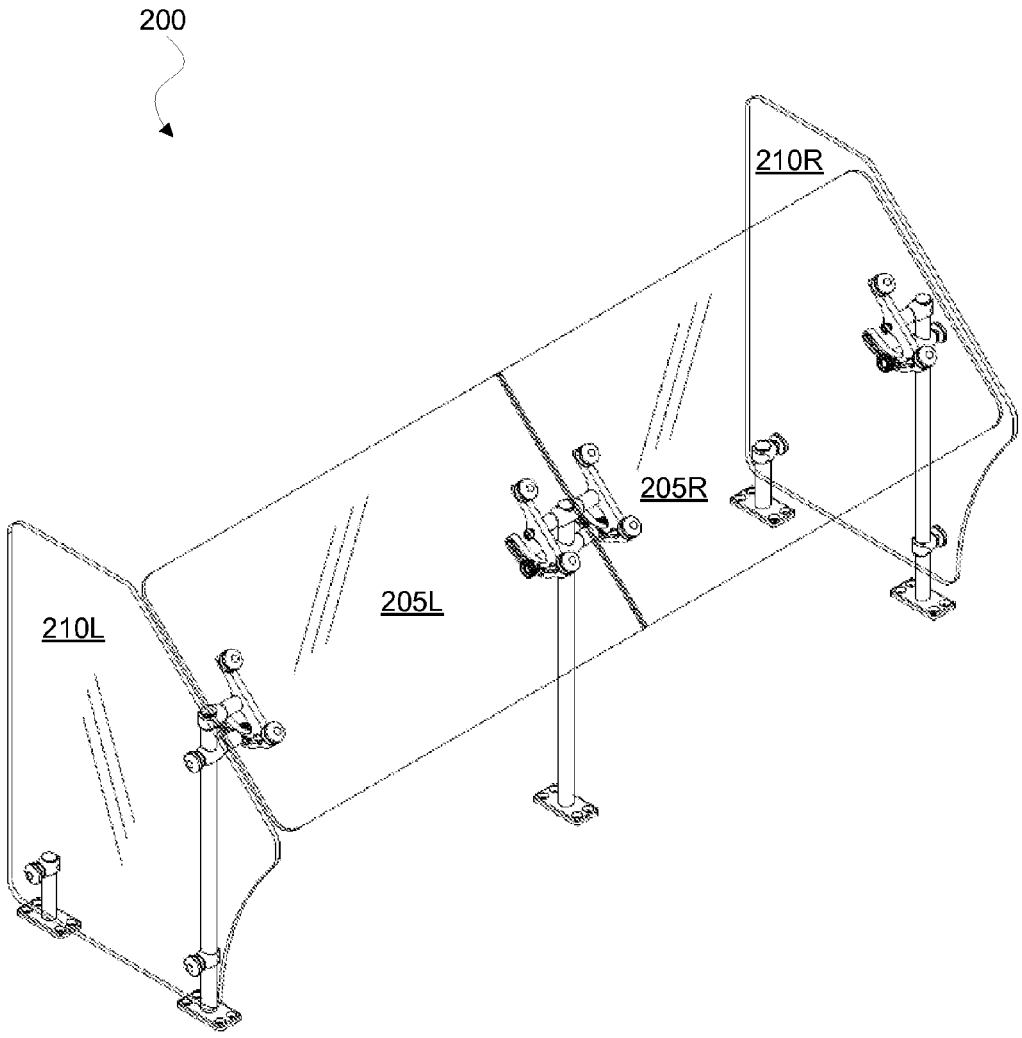
FIG. 2A illustrates an exemplary single-side self-serve food shield configuration that may be constructed from a combination of modular food shield system components that include the components depicted in FIGS. 1A-1E.

FIG. 2A illustrates an exemplary single-side self-serve food shield configuration 200 that may be constructed from a combination of modular food shield system components that include the components depicted in FIGS. 1A-1E. As can be seen in the FIG. 2A illustration, the single-side self-serve food shield configuration 200 includes a pair of left and right main viewing panels, 205L and 205R. The main viewing panels 205L, 205R are mounted to various support structure arrangements of support posts 105, versatile brackets 110, 115 and ancillary components such that the lower edges of the panels 205L, 205R are suspended above a food area.

At either end of the single-side self-serve food shield configuration 200 are left and right side panels, 210L and 210R. The side panels 210L, 210R are mounted to various support structure arrangements of support posts 105, versatile brackets 110, 115 and ancillary components such that the panels 210L, 210R form a barrier to access of the food area.

Figure 2B:
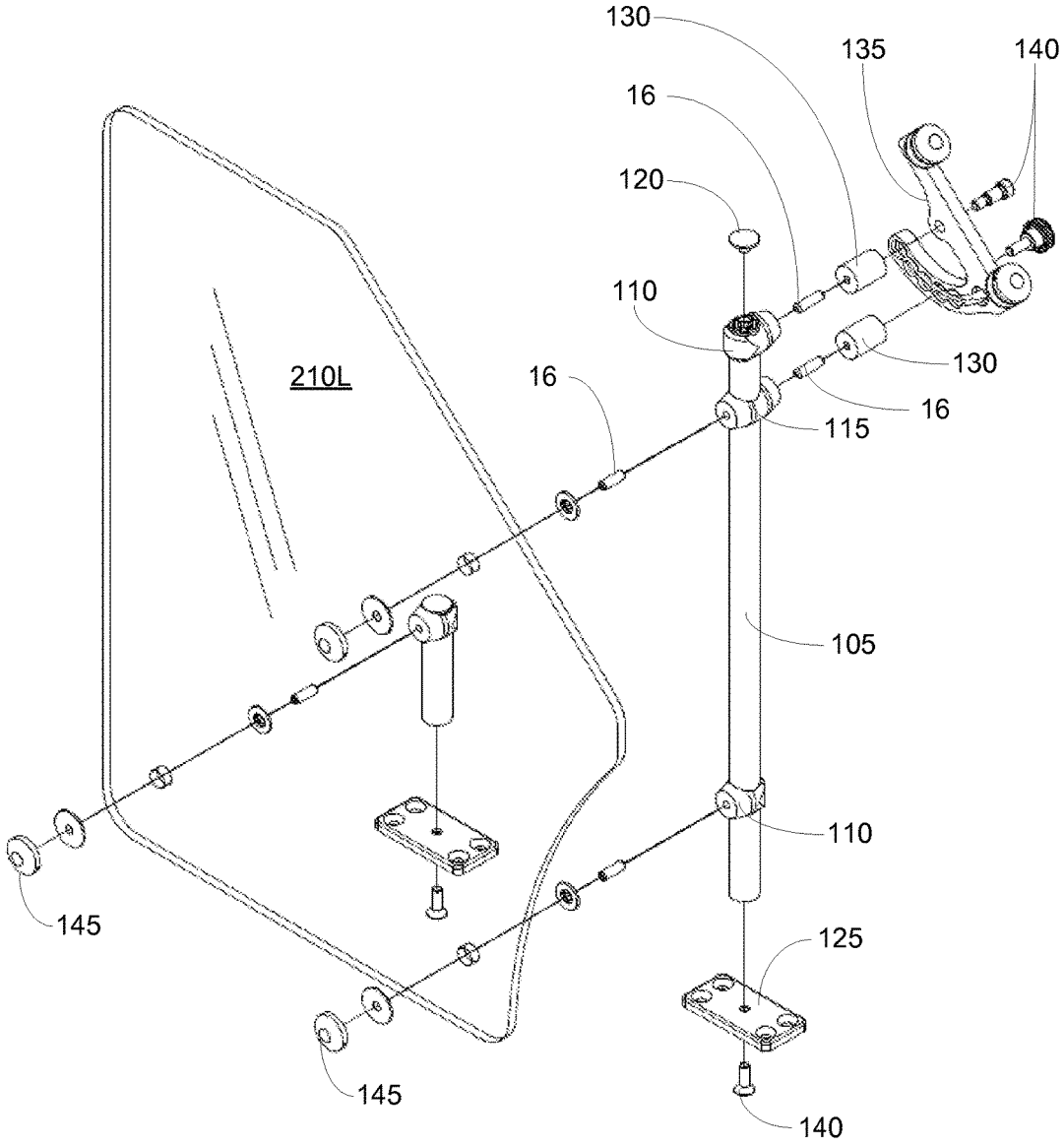
FIG. 2B is an exploded view of the left side panel section of the exemplary single-side self-serve food shield configuration shown in FIG. 2A.

FIG. 2B is an exploded view of the left side panel section of the exemplary single-side self-serve food shield configuration 200 shown in FIG. 2A. The exemplary support structure arrangements of support posts 105, versatile brackets 110, 115 and ancillary components used in the exemplary configuration 200 can be seen in more detail. Short and tall support posts 105 are positioned in rear and front locations, respectively. Mounted to the short support post 105 are a unidirectional bracket 110 and a top cap 120, as has been previously described. The short support post is mounted over a food area by virtue of a support base 125, as has been previously described. The double duty set screw 16 extending from the unidirectional bracket 110 on the rear support post 105 extends through a hole in the side panel 210L. A glass cap component 145 is also mounted to the double duty set screw 16 such that the side panel 210L is sandwiched between the glass cap component 145 and the flat mating surface 18 of the unidirectional bracket 110. Washers may also be sandwiched between the glass cap component 145 and the flat mating surface 18 of the unidirectional bracket 110, as would be understood by one of ordinary skill in the art.

Similarly, mounted to the taller, front support post 105 are two unidirectional brackets 110, a bidirectional bracket 115 and a top cap 120, as has been previously described. The support post 105 is mounted over a food area by virtue of a support base 125, as has been previously described. The uppermost unidirectional bracket 110 is oriented such that the mating surface 18 faces away from the side panel 210L and is in a position to support a main viewing panel adjustment bracket 135 (which can be seen in the FIG. 2A illustration to support a main viewing panel 205L). The double duty screw 16 extending from the uppermost unidirectional bracket 110 is shown received by an internally threaded barrel spacer 130. As would be understood by one of ordinary skill in the art, the end of the barrel spacer 130 may mate flush with the mating surface 18 of the bracket 110 such that substantially no crevice is formed. At the opposite end of the barrel spacer 130 from the uppermost unidirectional bracket 110, the main viewing panel adjustment bracket 135 may be mounted via a fastener 140.

Beneath the uppermost unidirectional bracket 110 on the support post is the bidirectional bracket 115. The bidirectional bracket 115 is oriented such that one of its two mating surfaces 18 faces the main viewing panel adjustment bracket 135 while the second of its two mating surfaces 18 faces the side panel 210L. The double duty screw 16 extending from the mating surface 18 facing the main viewing panel adjustment bracket 135 is shown received by an internally threaded barrel spacer 130. As would be understood by one of ordinary skill in the art, the end of the barrel spacer 130 may mate flush with the mating surface 18 of the bracket 110 such that substantially no crevice is formed. At the opposite end of the barrel spacer 130 from the bidirectional bracket 115, the main viewing panel adjustment bracket 135 may be adjusted in its angle via a fastener 140.

Returning to the second mating surface 18 of the bidirectional bracket 115 which faces the side panel 210L, the double duty set screw 16 extends through a hole in the side panel 210L such that the inside surface of the side panel 210L mates flush with the mating surface 18 of the bracket 115. A glass cap component 145 is also mounted to the double duty set screw 16 such that the side panel 210L is sandwiched between the glass cap component 145 and the flat mating surface 18. Washers may also be sandwiched between the glass cap component 145 and the flat mating surface 18 of the bidirectional bracket 110, as would be understood by one of ordinary skill in the art.

Beneath the bidirectional bracket 115 on the support post 115 is the lower unidirectional bracket 110. Similar to the unidirectional bracket 110 mounted on the rear support post 110 and the outward facing portion of the bidirectional bracket 115 located above it, the lower unidirectional bracket 110 is fixed in place by a double duty set screw 16 that extends from the bracket 110 and through a hole in the side panel 210L. A glass cap component 145 is also mounted to the double duty set screw 16 such that the side panel 210L is sandwiched between the glass cap component 145 and the flat mating surface 18 of the lower unidirectional bracket 110. Washers may also be sandwiched between the glass cap component 145 and the flat mating surface 18 of the lower unidirectional bracket 110, as would be understood by one of ordinary skill in the art.

As would be apparent to one of ordinary skill in the art viewing the FIG. 2B illustration, the side panel 210L is supported by the support structure arrangements by virtue of being mounted to the various versatile brackets 110, 115. Similarly, the exemplary ancillary components in the form of barrel spacers 130 and main viewing panel adjustment bracket 135 are supported by support structure arrangements by virtue of being mounted to the various versatile brackets 110, 115. The specific combinations of modular food shield system components shown in the FIG. 2 illustrations are exemplary in nature and are meant to suggest that any combination of components may be used as needed to form a desired food shield configuration. Advantageously, regardless of the particular food shield configuration that may be required for an application, one of ordinary skill in the art will recognize that the configuration may be installed with minimum parts inventory when using a modular food shield system due to the versatile nature of the bracket components and cut-to-length ability of the support post stock.

Figure 2C:
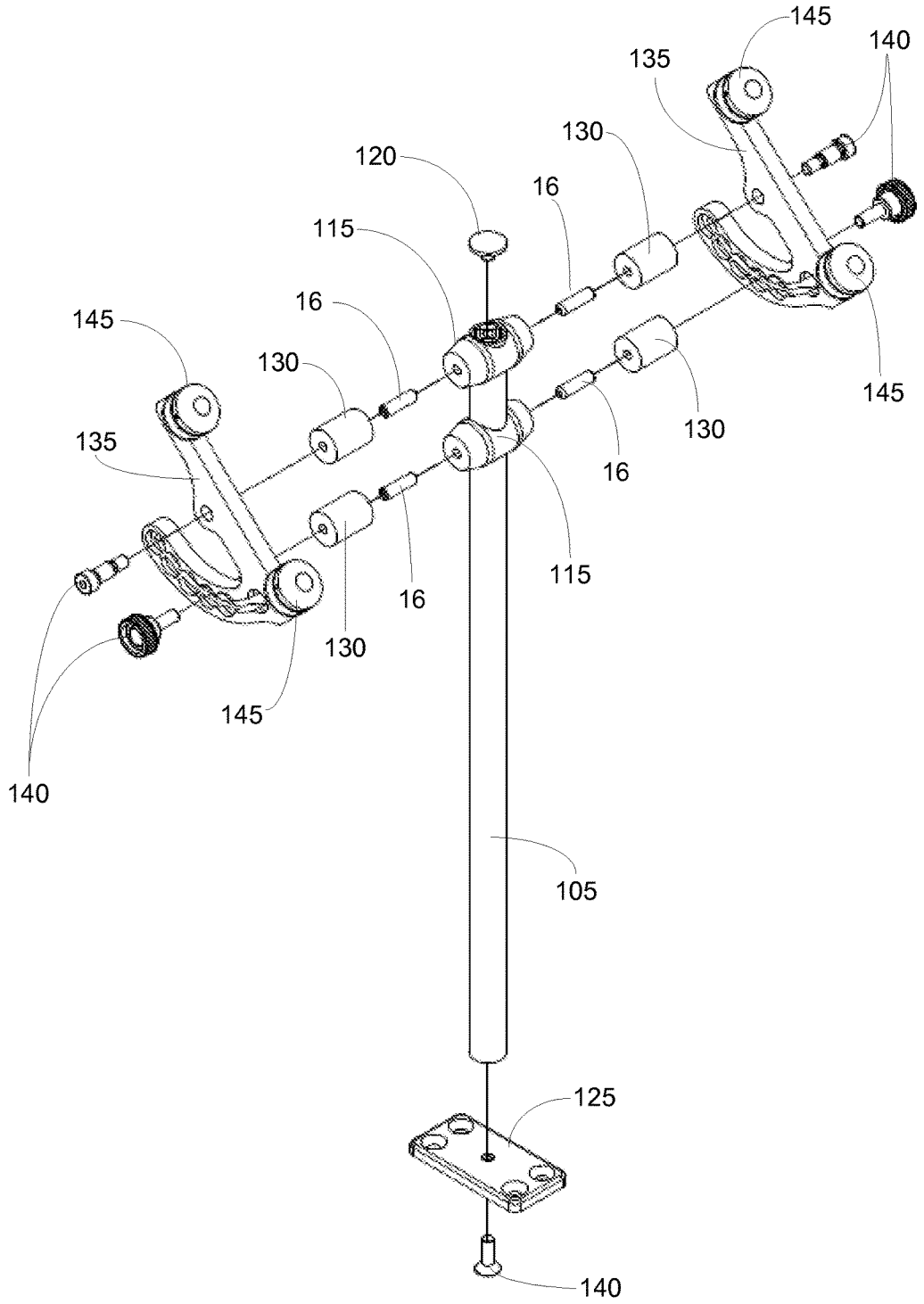
FIG. 2C is an exploded view of the middle support structure of the exemplary single-side self-serve food shield configuration shown in FIG. 2A.

FIG. 2C is an exploded view of the middle support structure of the exemplary single-side self-serve food shield configuration 200 shown in FIG. 2A. Similar to the exemplary support structure arrangements depicted and described relative to FIG. 2B, the middle support structure arrangement shown in more detail in FIG. 2C includes a support post 105 that may have been cut-to-length from a stock of extruded post (see FIG. 1A). The support post 105 is mounted to a food area via a support base 125. Positioned at the upper end of the support post 105 are two bidirectional brackets 115 which are oriented to provide support for a pair of main viewing panel adjustment brackets 135. As previously described, the double duty set screws 16 may secure their respective bidirectional brackets 115 to the support post 105 while also providing a means for receiving and supporting ancillary components. In the FIG. 2C illustration, the ancillary components are barrel spacers 130, main viewing panel adjustment brackets 135 and fasteners 140. The glass cap fasteners 145 may be used to mount a main viewing panel 205 to a main viewing panel adjustment bracket 135, similar to that which has been previously described.

As one of ordinary skill in the art will recognize from the drawings and their related descriptions, food shield configurations constructed from a modular food shield system need not be configured such that the mounting surfaces 18 of the various versatile brackets 110, 115 are facing in parallel directions. That is, by orienting versatile brackets 110, 115 in various directions relative to one another, food shield configurations may "turn" corners or be made to follow the line of a curved serving surface.

Figure 3A:
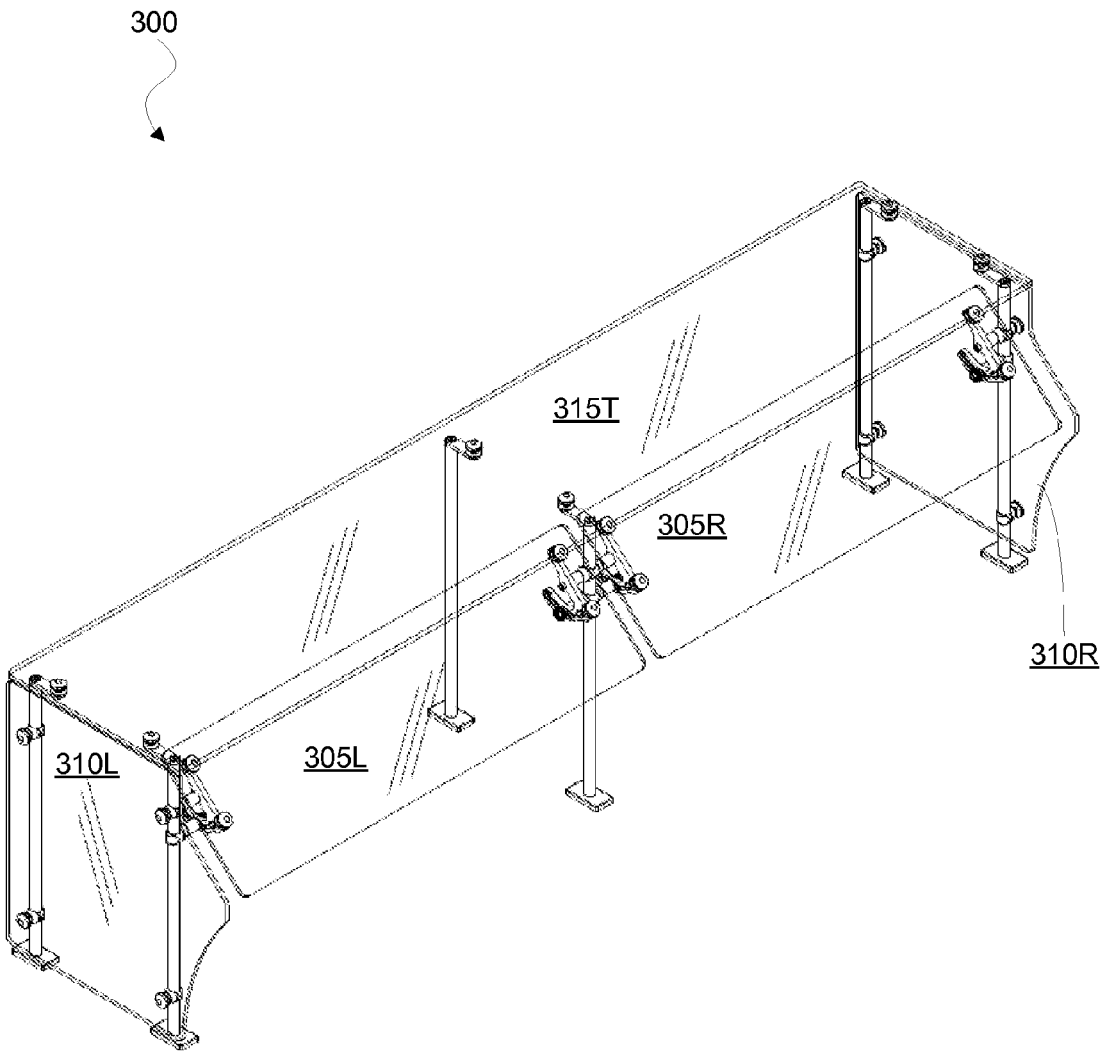
FIG. 3A illustrates an exemplary single-side self-serve food shield configuration that may be constructed from a combination of modular food shield system components that include the components depicted in FIGS. 1A-1E.

FIG. 3A illustrates an exemplary single-side self-serve food shield configuration 300 that may be constructed from a combination of modular food shield system components that include the components depicted in FIGS. 1A-1E. Similar to the FIG. 2A illustration, the single-side self-serve food shield configuration 300 includes a pair of left and right main viewing panels, 305L and 305R. The main viewing panels 305L, 305R are mounted to various support structure arrangements of support posts 105, versatile brackets 110, 115 and ancillary components such that the lower edges of the panels 305L, 305R are suspended above a food area. At either end of the single-side self-serve food shield configuration 300, are left and right side panels, 310L and 310R. The side panels 310L, 31 OR are mounted to various support structure arrangements of support posts 105, versatile brackets 110, 115 and ancillary components such that the panels 310L, 31 OR form a barrier to access of the food area. A top panel 315T is also mounted to the various support structure arrangements that are supporting the main viewing panels 305 and side panels 310.

Figure 3B:
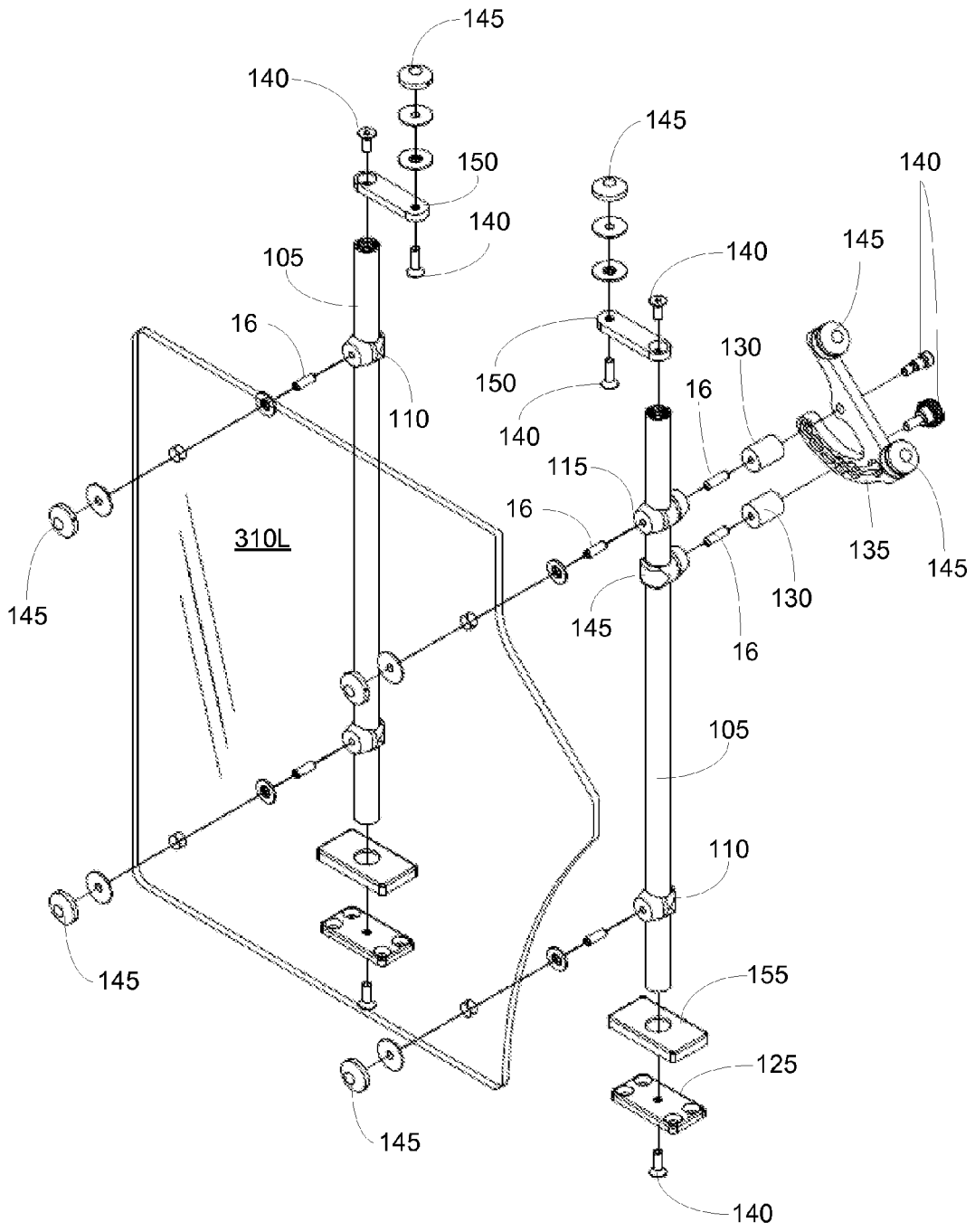
FIG. 3B is an exploded view of the left side panel section of the exemplary single-side self-serve food shield configuration shown in FIG. 3A.

FIG. 3B is an exploded view of the left side panel section of the exemplary single-side self-serve food shield configuration 300 shown in FIG. 3A. Portions of the description of FIGS. 2B and 2C are applicable to the FIG. 3B illustration. The rear support post 105 includes upper and lower unidirectional brackets 110 fixed thereon and supporting side panel 310L in the manner previously described. The front support post 105 includes a bidirectional bracket 115 and two unidirectional brackets 110 positioned beneath bidirectional bracket 115. One side of the bidirectional bracket 115 and the lowermost unidirectional bracket 110 support side panel 310L in the manner previously described. The opposite side of the bidirectional bracket 115 and the middle unidirectional bracket 110 support ancillary components as previously described, including a main viewing panel adjustment bracket 135.

Also shown in the FIG. 3B illustration are covers 155 for covering support base 125. The covers 155 may improve aesthetics of the food shield installation as well as prevent exposure of the fasteners through support base 125 to food splatter. As can further be seen in the FIG. 3B illustration, fasteners 140 may be received into a hub feature 14 on the lower end of a support post 105 in order to secure the support base 125 to the post 105. Similarly, fasteners 140 may be received into a hub feature 14 on the upper end of a support post 105 in order to secure a top panel support component 150 to the post 105. Notably, it is envisioned that components other than end caps and top panel support components may secured to the hub feature of a support post via a fastener such as, but not limited to, brackets, extensions, etc.

Figure 3C:
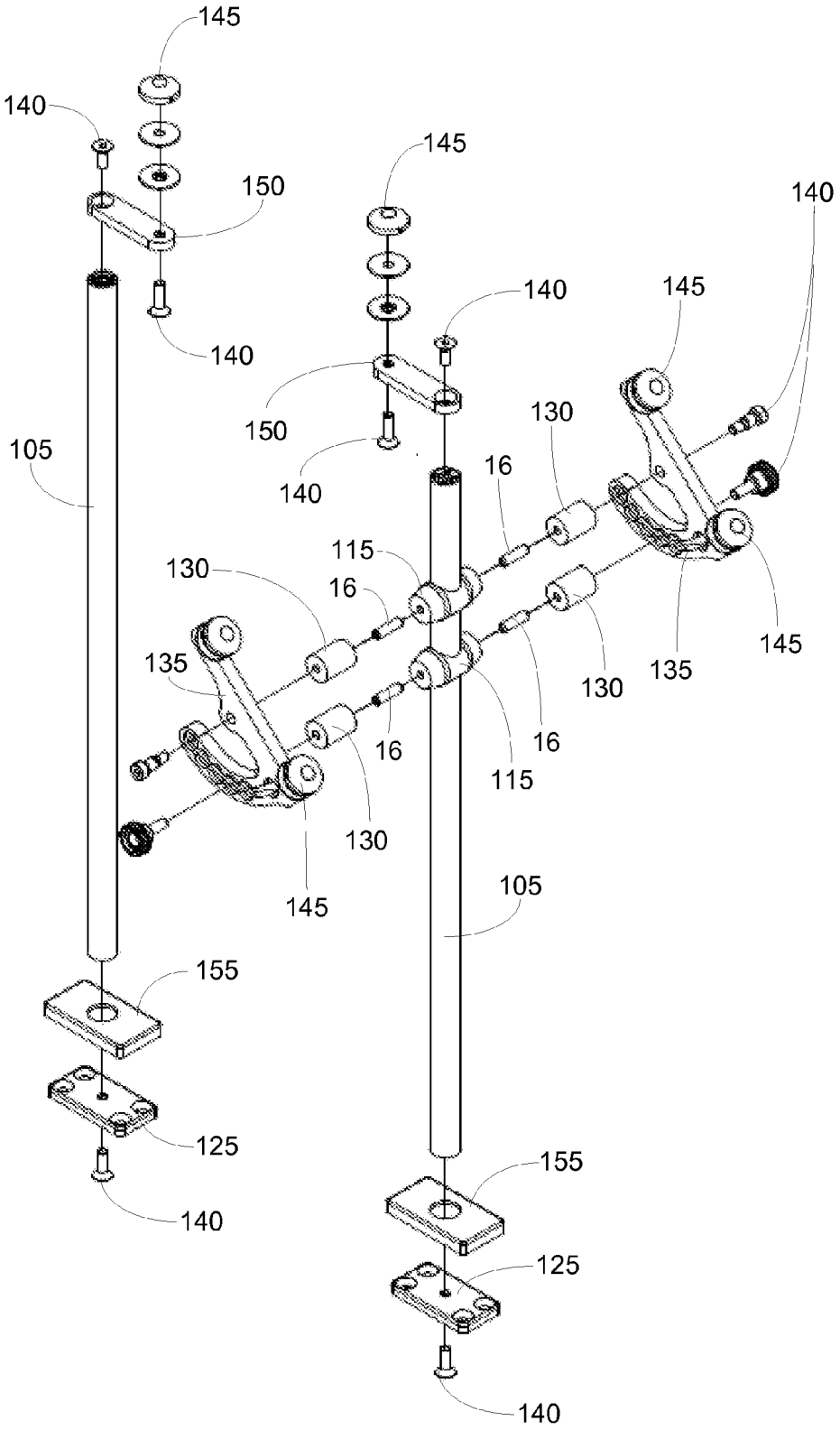
FIG. 3C is an exploded view of the middle support structure of the exemplary single-side self-serve food shield configuration shown in FIG. 3A.

FIG. 3C is an exploded view of the middle support structure of the exemplary single-side self-serve food shield configuration 300 shown in FIG. 3A. Portions of the description of FIGS. 2B, 2C and 3B are applicable to the FIG. 3C illustration, as would be apparent to one of ordinary skill in the art. The FIG. 3C illustration is included to provide further detail regarding the exemplary FIG. 3A configuration 300.

Figure 4A:
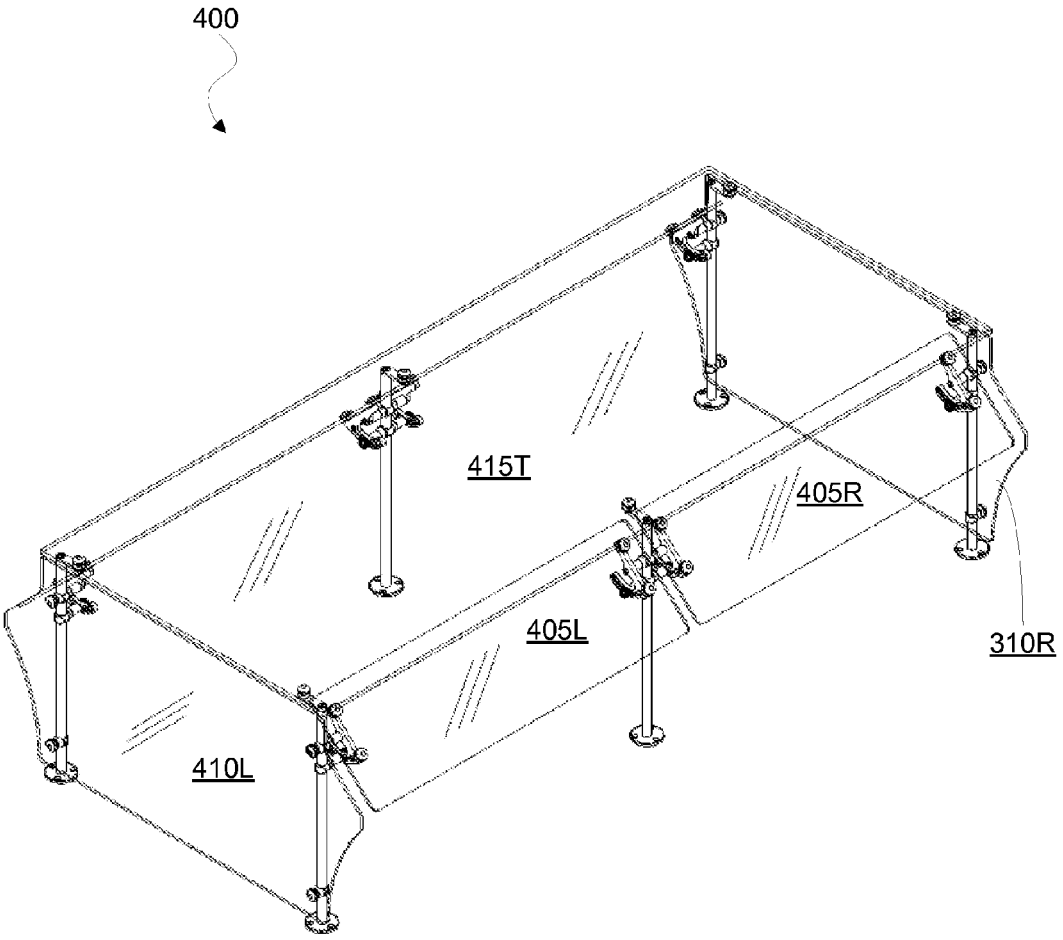
FIG. 4A illustrates an exemplary double-side self-serve food shield configuration that may be constructed from a combination of modular food shield system components that include the components depicted in FIGS. 1A-1E.

FIG. 4A illustrates an exemplary double-side self-serve food shield configuration 400 that may be constructed from a combination of modular food shield system components that include the components depicted in FIGS. 1A-1E. Similar to the FIGS. 2A and 3A illustration, the double-side self-serve food shield configuration 400 includes a pair of left and right main viewing panels, 405L and 405R. Complimentary left and right main viewing panels (not easily seen in the FIG. 4A illustration) are featured on the opposite side of the configuration 400. The main viewing panels 405L, 405R and their complimentary panels are mounted to various support structure arrangements of support posts 105, versatile brackets 110, 115 and ancillary components such that the lower edges of the panels 405 are suspended above a food area. At either end of the double-side self-serve food shield configuration 400, are left and right side panels, 410L and 410R. The side panels 410L, 410R are mounted to various support structure arrangements of support posts 105, versatile brackets 110, 115 and ancillary components such that the panels 410L, 410R form a barrier to access of the food area. A top panel 415T is also mounted to the various support structure arrangements that are supporting the main viewing panels 405 and side panels 410.

Figure 4B:
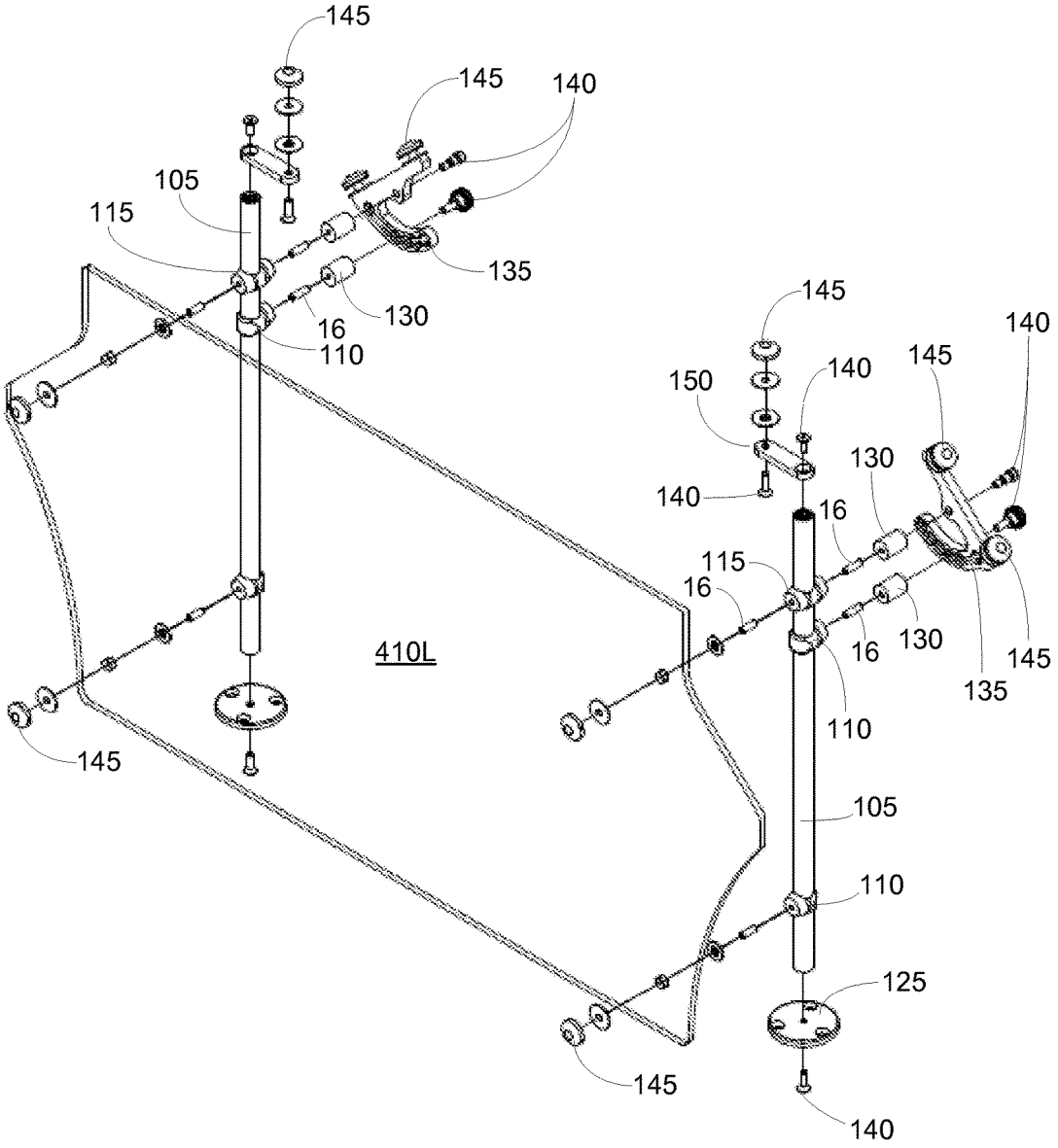
FIG. 4B is an exploded view of the left side panel section of the exemplary double-side self-serve food shield configuration shown in FIG. 4A.

FIG. 4B is an exploded view of the left side panel section of the exemplary double-side self-serve food shield configuration 400 shown in FIG. 4A. Portions of the description of FIGS. 2B, 2C and 3B are applicable to the FIG. 4B illustration, as would be apparent to one of ordinary skill in the art. The FIG. 4B illustration is included to provide further detail regarding the exemplary FIG. 4A configuration 400. Notably, the exemplary support base 125 seen in the FIG. 4B illustration is round in form.

Figure 4C:
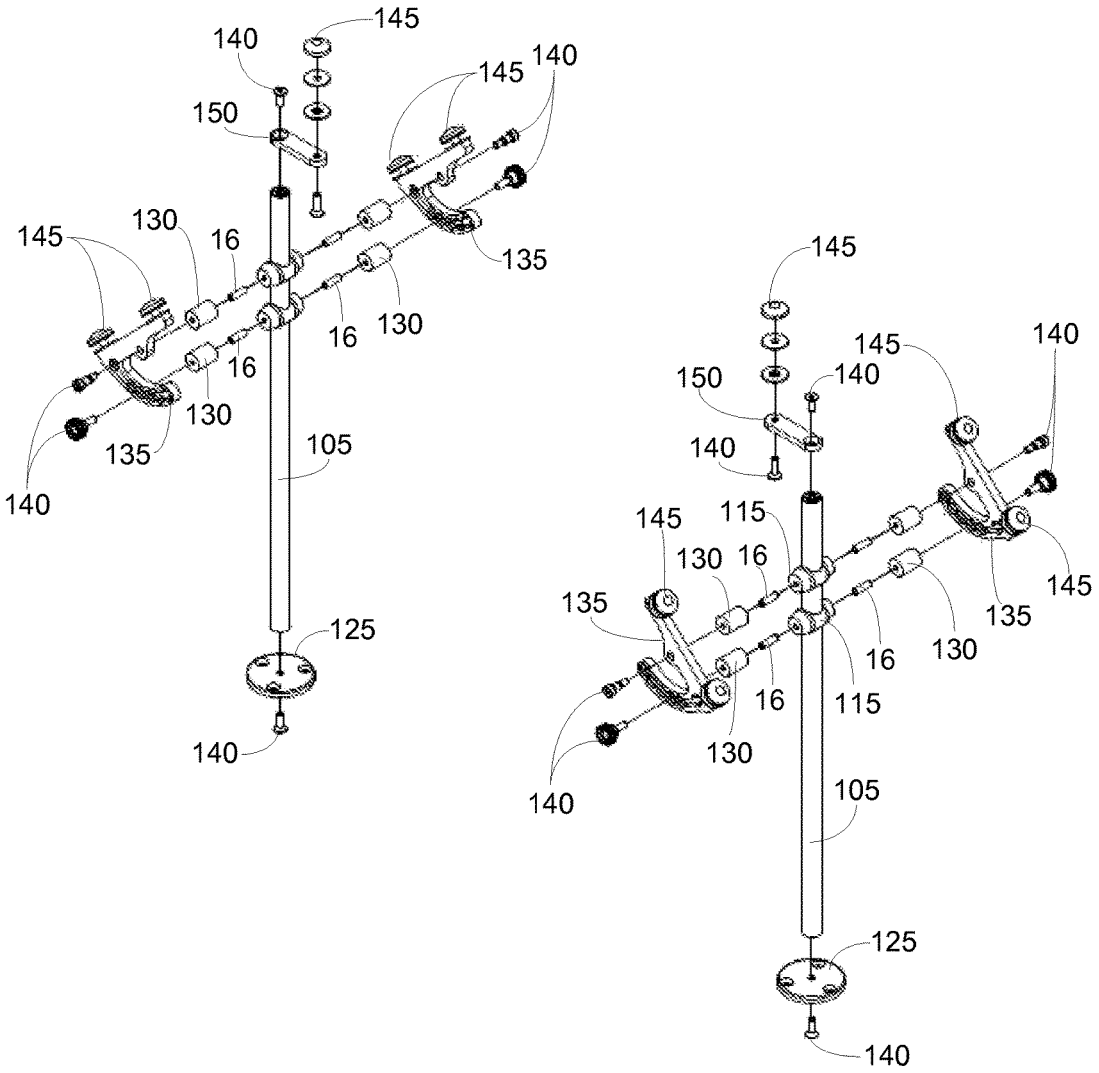
FIG. 4C is an exploded view of the middle support structure of the exemplary double-side self-serve food shield configuration shown in FIG. 4A.

FIG. 4C is an exploded view of the middle support structure of the exemplary double-side self-serve food shield configuration 400 shown in FIG. 4A. Portions of the description of FIGS. 2B, 2C and 3B are applicable to the FIG. 4C illustration, as would be apparent to one of ordinary skill in the art. The FIG. 4C illustration is included to provide further detail regarding the exemplary FIG. 4A configuration 400.

Figure 5A:
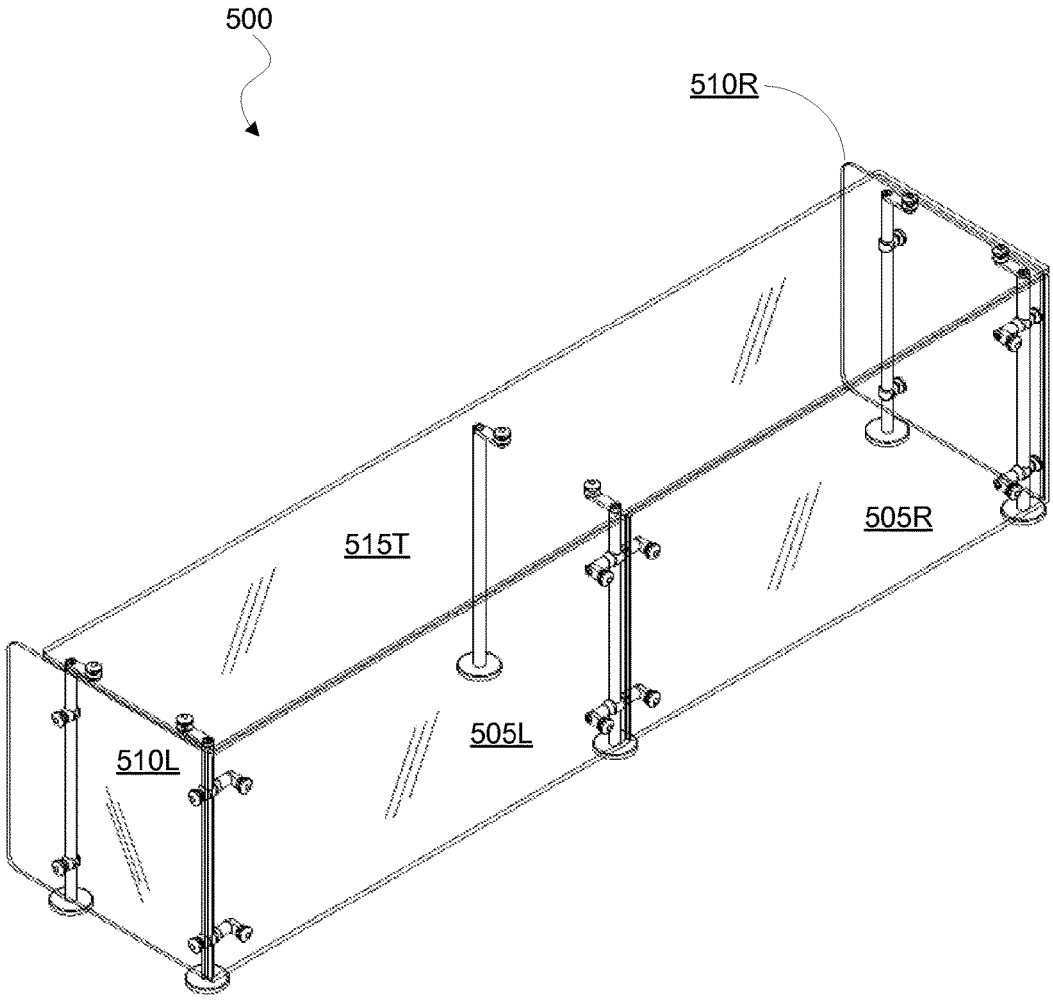
FIG. 5A illustrates an exemplary attendant-served food shield configuration that may be constructed from a combination of modular food shield system components that include the components depicted in FIGS. 1A-1E.

FIG. 5A illustrates an exemplary attendant-served food shield configuration 500 that may be constructed from a combination of modular food shield system components that include the components depicted in FIGS. 1A-1E. The exemplary attendant-served food shield configuration 500 includes a pair of left and right main viewing panels, 505L and 505R. The main viewing panels 505L, 505R are mounted to various support structure arrangements of support posts 105, versatile brackets 110, 115 and ancillary components such that the lower edges of the panels 505L, 505R form a barrier to access of the food area. At either end of the exemplary attendant-served food shield configuration 500 are left and right side panels, 510L and 510R. The side panels 510L, 51 OR are mounted to various support structure arrangements of support posts 105, versatile brackets 110, 115 and ancillary components such that the panels 510L, 510R form a barrier to access of the food area. A top panel 515T is also mounted to the various support structure arrangements that are supporting the main viewing panels 505 and side panels 510.

Figure 5B:
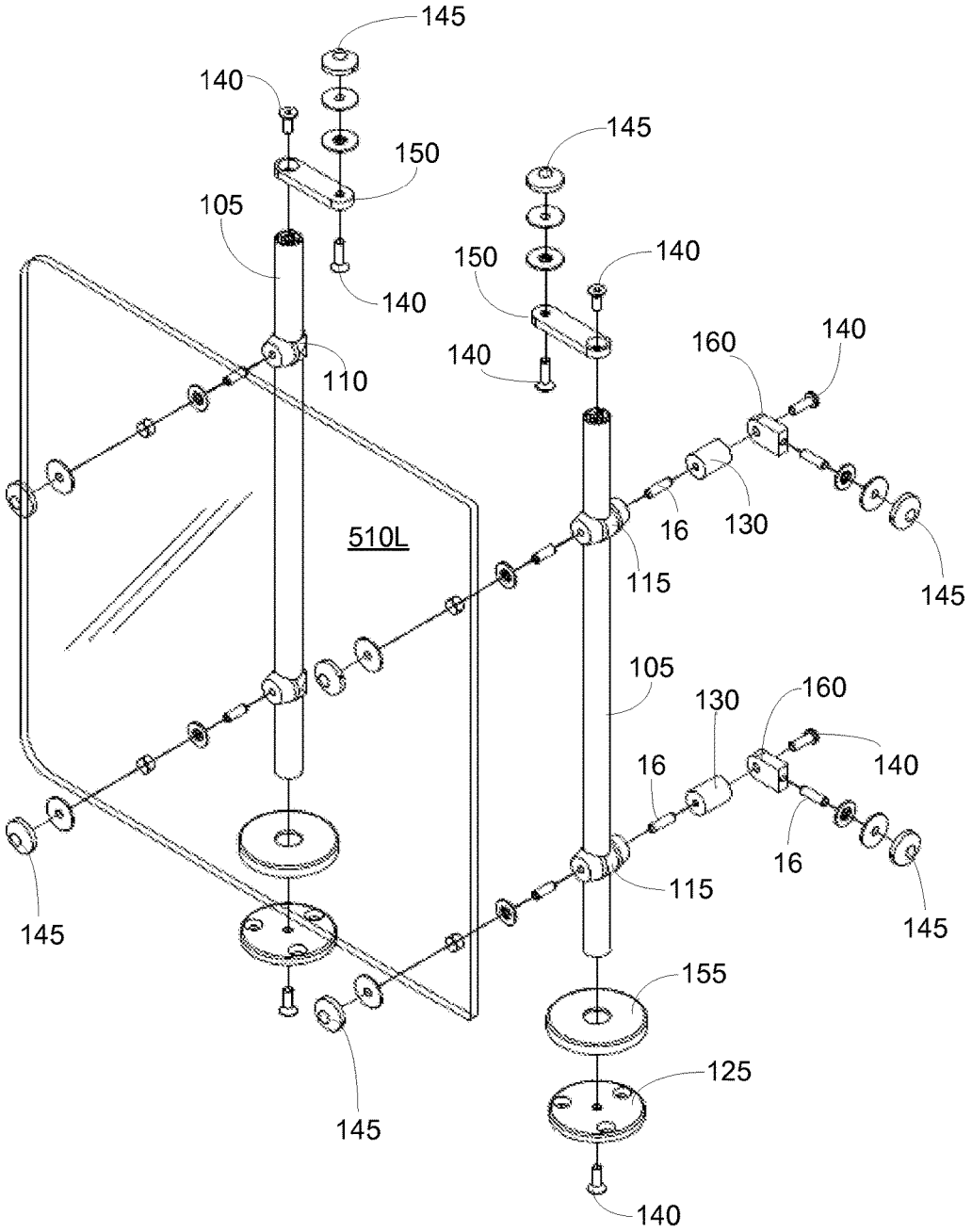
FIG. 5B is an exploded view of the left side panel section of the exemplary attendant-served food shield configuration shown in FIG. 5A.

FIG. 5B is an exploded view of the left side panel section of the exemplary attendant-served food shield configuration 500 shown in FIG. 5A. Portions of the description of FIGS. 2B, 2C and 3B are applicable to the FIG. 5B illustration, as would be apparent to one of ordinary skill in the art. The FIG. 5B illustration is included to provide further detail regarding the exemplary FIG. 5A configuration 500. Notably, the exemplary support base 125 seen in the FIG. 5B illustration is round in form, as is the exemplary support base cover 155. As can further be seen in FIG. 5B, a nonadjustable main viewing panel bracket 160 may be anchored to a spacer 130 such that it can receive and support a main viewing panel 505, similar in manner to that which has been previously described relative to side panels. Notably, although the bracket 160 is shown mounted to a spacer 130 in the FIG. 5B illustration, it is envisioned that in other configurations the bracket 160 may be anchored directly to a double duty set screw 16.

Figure 5C:
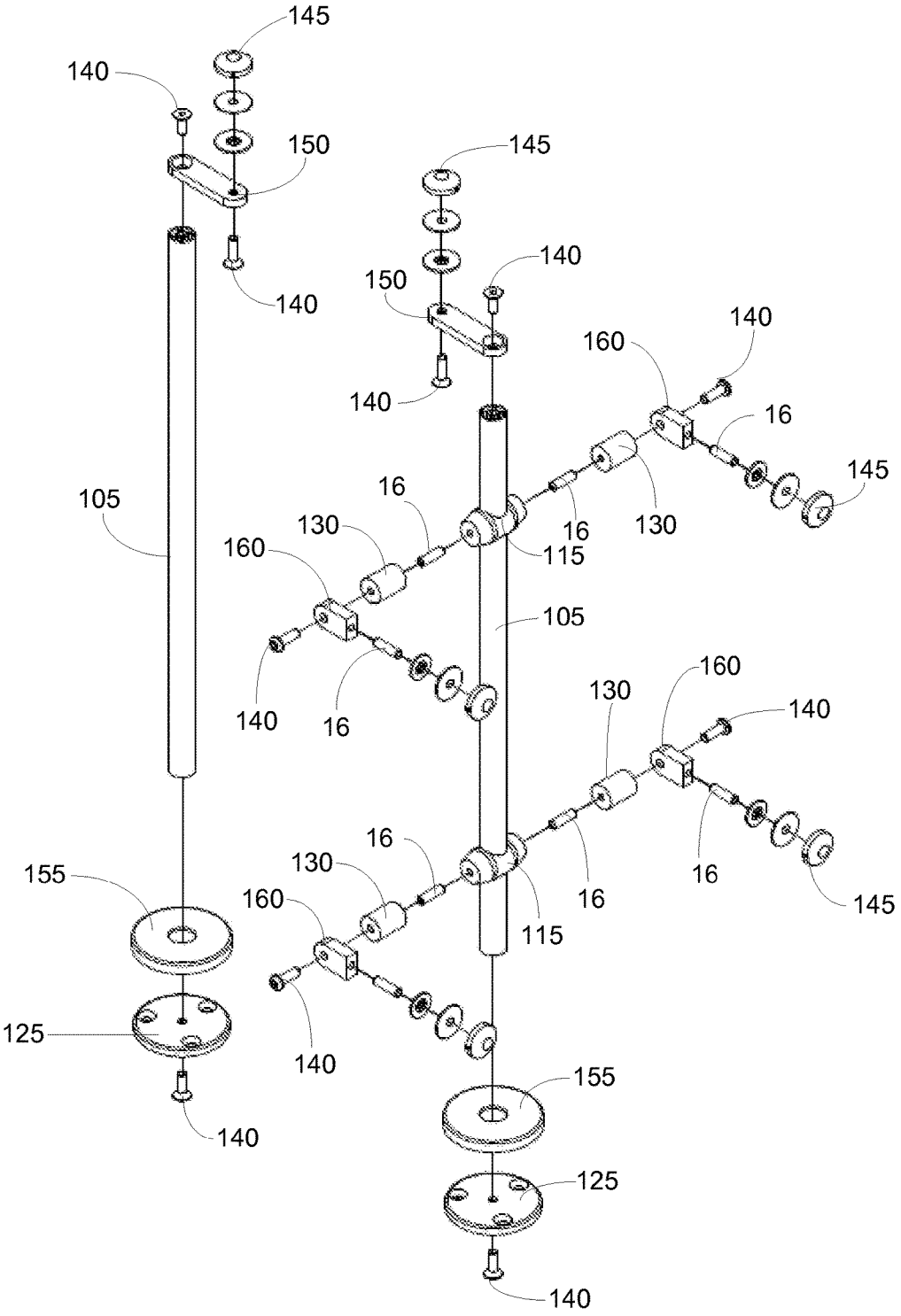
FIG. 5C is an exploded view of the middle support structure of the exemplary attendant-served food shield configuration shown in FIG. 5A.

FIG. 5C is an exploded view of the middle support structure of the exemplary attendant-served food shield configuration 500 shown in FIG. 5A. Portions of the description of FIGS. 2B, 2C, 3B and 5B are applicable to the FIG. 5C illustration, as would be apparent to one of ordinary skill in the art. The FIG. 5C illustration is included to provide further detail regarding the exemplary FIG. 5A configuration 500.

Figure 6A:
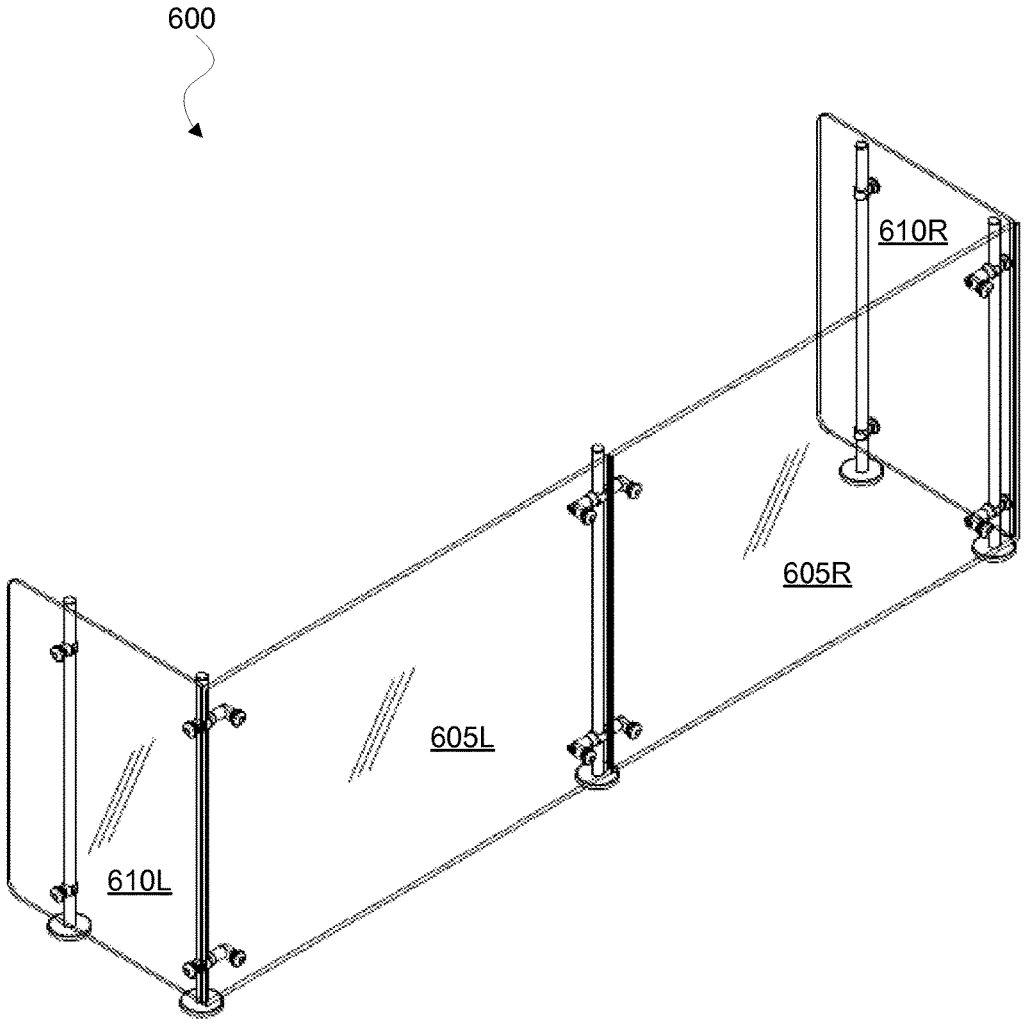
FIG. 6A illustrates an exemplary attendant-served food shield configuration that may be constructed from a combination of modular food shield system components that include the components depicted in FIGS. 1A-1E.

FIG. 6A illustrates an exemplary attendant-served food shield configuration 600 that may be constructed from a combination of modular food shield system components that include the components depicted in FIGS. 1A-1E. The exemplary attendant-served food shield configuration 600 includes a pair of left and right main viewing panels, 605L and 605R. The main viewing panels 605L, 605R are mounted to various support structure arrangements of support posts 105, versatile brackets 110, 115 and ancillary components such that the lower edges of the panels 605L, 605R form a barrier to access of the food area. At either end of the exemplary attendant-served food shield configuration 600 are left and right side panels, 610L and 610R. The side panels 610L, 61 OR are mounted to various support structure arrangements of support posts 105, versatile brackets 110, 115 and ancillary components such that the panels 610L, 610R form a barrier to access of the food area.

Figure 6B:
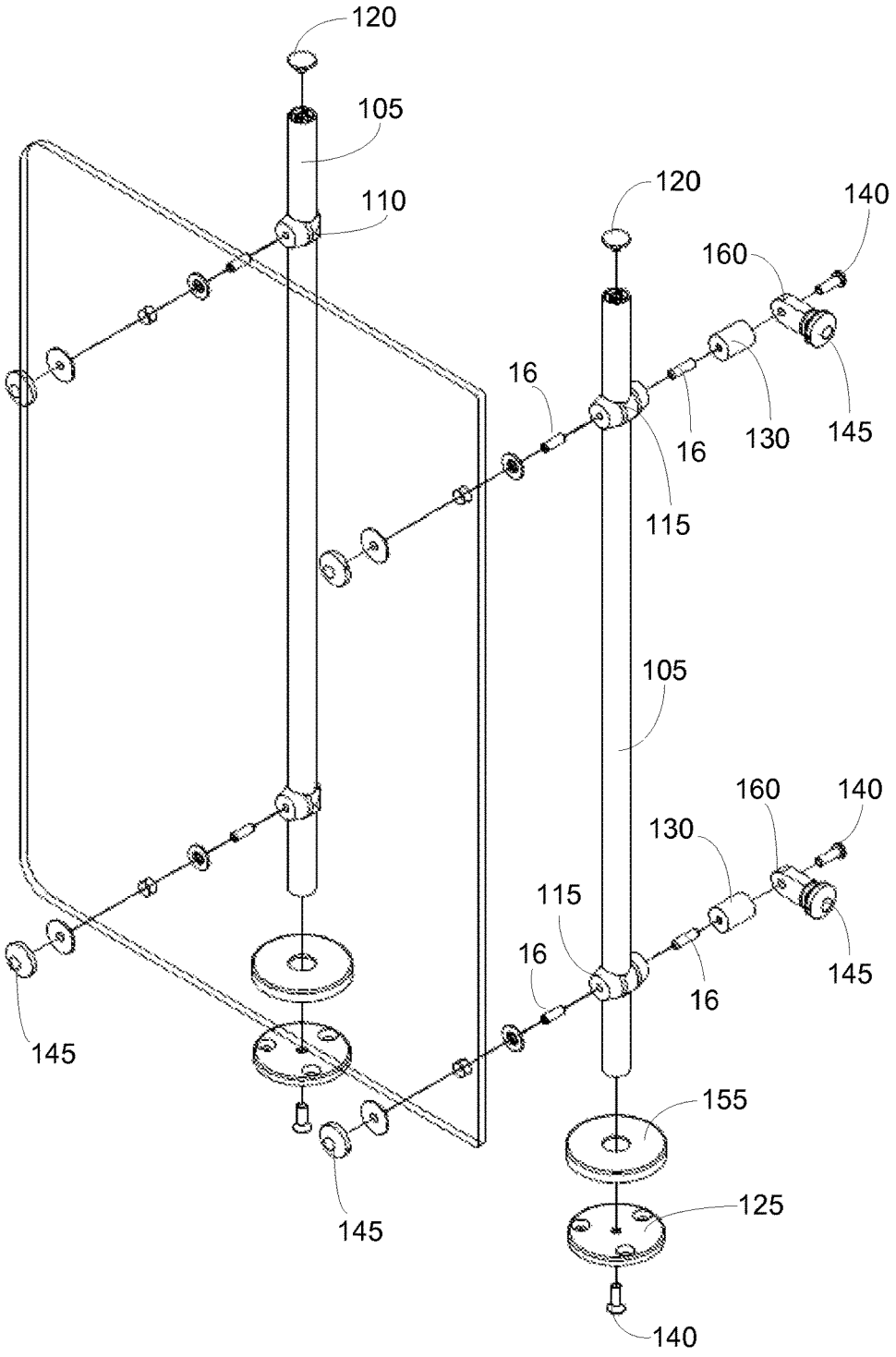
FIG. 6B is an exploded view of the left side panel section of the exemplary attendant-served food shield configuration shown in FIG. 6A.

FIG. 6B is an exploded view of the left side panel section of the exemplary attendant-served food shield configuration 600 shown in FIG. 6A. Portions of the description of FIGS. 2B, 2C, 3B and 5B are applicable to the FIG. 6B illustration, as would be apparent to one of ordinary skill in the art. The FIG. 6B illustration is included to provide further detail regarding the exemplary FIG. 6A configuration 600.

Figure 6C:
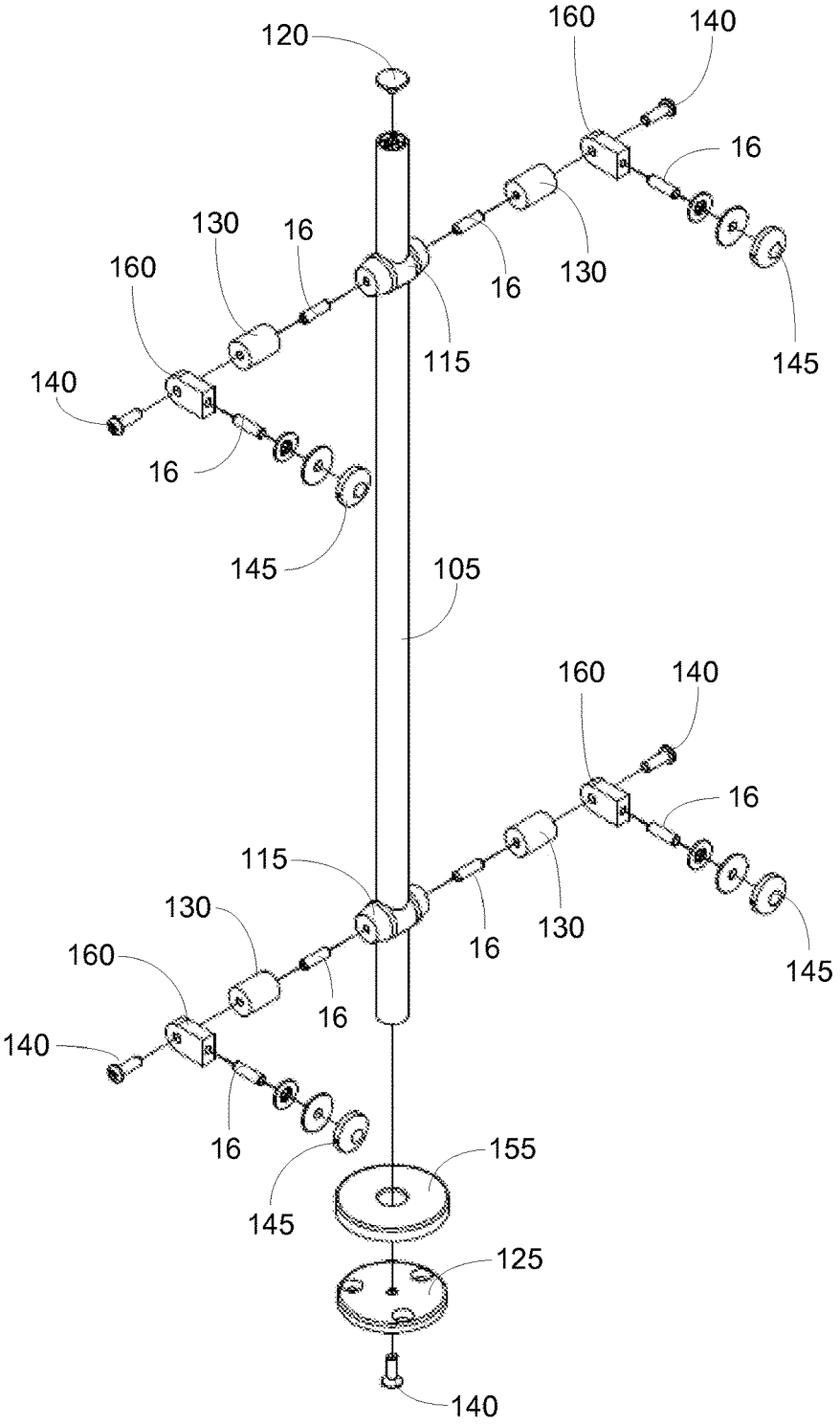
FIG. 6C is an exploded view of the middle support structure of the exemplary attendant-served food shield configuration shown in FIG. 6A.

FIG. 6C is an exploded view of the middle support structure of the exemplary attendant-served food shield configuration 600 shown in FIG. 6A. Portions of the description of FIGS. 2B, 2C, 3B and 5B are applicable to the FIG. 6C illustration, as would be apparent to one of ordinary skill in the art. The FIG. 6C illustration is included to provide further detail regarding the exemplary FIG. 6A configuration 600.

It should be noted that although the embodiments of the modular food shield system described above refer to the support structure of the exemplary configurations as being attached to a countertop or surface, this is not necessarily the case in all applications. For example, the support structure of a particular configuration of a modular food shield system may instead be suspended about the countertop from the ceiling of the establishment or from some other structure disposed above the countertop. Also, while the exemplary configurations described above depict a side panel mounted on each end thereof, a single side panel may be all that is needed in certain applications, such as, for example, in applications in which one end of the installation is positioned adjacent to, or in abutment with, a wall or other structure.

The present modular food shield system has been described using detailed descriptions of embodiments thereof that are provided by way of example and are not intended to limit the scope of the system. The described embodiments comprise different features, not all of which are required in all embodiments of a modular food shield system. Some embodiments of a modular food shield system utilize only some of the features or possible combinations of the features. Variations of embodiments of a modular food shield system that are described and embodiments of a modular food shield system comprising different combinations of features noted in the described embodiments will occur to persons of the art.

Moreover, it will be appreciated by persons skilled in the art that a modular food shield system is not limited by what has been particularly shown and described herein above. Rather, the scope of a modular food shield system is defined by the claims that follow.

What is claimed is:

1. A modular food shield system comprising:

a support post having an upper end, a lower end and an outer surface defining a length between the upper end and lower end, wherein the outer surface is free of drilled holes the support post further comprising at least four spoke elements extending from the outer surface of the support post to a centrally located hub element, the hub element defining a closed cylindrical geometry for receiving a fastener of a top cap component at the upper end of the support post;

two or more brackets adjustably mounted to the support post, each said bracket comprising a contour section that extends away from the support post, each said contour section having a frustum shape with a circular cross-section surrounding a bore, each said bracket comprising a substantially continuous and uniform solid material;

a viewing panel mounted to at least one of the two or more brackets; and an ancillary component mounted to each of the two or more brackets;

wherein each of the two or more brackets comprises a double duty set screw that tightens through the bore of the contour section of one of the two or more brackets, each said set screw consisting of first and second threaded ends and configured to fix a position of said one of the two or more brackets on the support post by penetrating past the bore with the first threaded end and by receiving one of the ancillary components with the second threaded end such that the double duty set screw is concealed from exposure to splashed food by the ancillary component, the system substantially reducing open seams, recesses or unnecessary projections that may result from mating components in order to avoid exposure to splashed food.

2. The modular food shield system of claim 1, further comprising one of a top panel support component and a bracket mounted to the upper end of the support post.

3. The modular food shield system of claim 1, further comprising a support base mounted to the lower end of the support post.

4. The modular food shield system of claim 3, further comprising a support base cover.

5. The modular food shield system of claim 1, wherein the outer surface of the support post is smooth.

6. The modular food shield system of claim 1, wherein at least one of the two or more brackets is a unidirectional bracket.

7. The modular food shield system of claim 1, wherein at least one of the two or more brackets is a bidirectional bracket.

8. The modular food shield system of claim 1, wherein each of the two or more brackets comprises a curved contour.

9. The modular food shield system of claim 1, wherein at least one of the ancillary components mounted to the two or more brackets is a glass cap component for securing a viewing panel to a bracket.

10. The modular food shield system of claim 1, wherein at least one of the ancillary components mounted to the two or more brackets is a barrel spacer.

11. The modular food shield system of claim 10, further comprising a main viewing panel adjustment bracket mounted to the barrel spacer via a fastener.

12. The modular food shield system of claim 10, further comprising a nonadjustable main viewing panel bracket mounted to the barrel spacer via a fastener.

13. The modular food shield system of claim 1, wherein the two or more brackets adjustably mounted to the support post are configured to be repositioned vertically and circumferentially on the support post.

14. The modular food shield system of claim 1, wherein any gap between any of said brackets and the support post does not exceed 0.015 inches.

15. The modular food shield system of claim 1, wherein the viewing panel is flush mounted to at least one of the two or more brackets.

16. The modular food shield system of claim 1, wherein the modular food shield system is configured as a single-side self-serve food shield.

17. The modular food shield system of claim 1, wherein the modular food shield system is configured as a double-side self-serve food shield.

18. The modular food shield system of claim 1, wherein the modular food shield system is configured as a attendant-served food shield.

19. A modular food shield system comprising:

a support post having an upper end, a lower end and an outer surface defining a length between the upper end and lower end, wherein the outer surface is free of drilled holes the support post further comprising at least four spoke elements extending from the outer surface of the support post to a centrally located hub element, the hub element defining a closed cylindrical geometry for receiving a fastener of a top cap component at the upper end of the support post;

a bracket adjustably mounted to the support post, the bracket comprising a contour section that extends away from the support post, the contour section having a frustum shape with a circular cross-section surrounding a bore, the bracket comprising a substantially continuous and uniform solid material; and an ancillary component mounted to the bracket;

wherein the bracket comprises a double duty set screw that tightens through the bore of the contour section of the bracket, the set screw consisting of two threaded ends and configured to fix a position of the bracket on the support post by penetrating past the bore with the first threaded end and by receiving the ancillary component with the second threaded end such that the double duty set screw is concealed from exposure to splashed food by the ancillary component, the system substantially reducing open seams, recesses or unnecessary projections that may result from mating components in order to avoid exposure to splashed food.

20. The modular food shield system of claim 19, further comprising a support base mounted to the lower end of the support post.

21. The modular food shield system of claim 20, further comprising a support base cover.

22. The modular food shield system of claim 19, wherein the outer surface of the support post is smooth.

23. The modular food shield system of claim 19, wherein the bracket is a unidirectional bracket.

24. The modular food shield system of claim 19, wherein the bracket is a bidirectional bracket.

25. The modular food shield system of claim 19, wherein the bracket comprises a curved contour.

26. The modular food shield system of claim 19, wherein the ancillary component is a glass cap component for securing a viewing panel to a bracket.

27. The modular food shield system of claim 19, wherein the ancillary component is a barrel spacer.

28. The modular food shield system of claim 27, further comprising a main viewing panel adjustment bracket mounted to the barrel spacer via a fastener.

29. The modular food shield system of claim 27, further comprising a nonadjustable main viewing panel bracket mounted to the barrel spacer via a fastener.

30. The modular food shield system of claim 19, wherein the bracket is configured to be repositioned vertically and circumferentially on the support post.

31. The modular food shield system of claim 19, wherein any gap between the bracket and the support post does not exceed 0.015 inches.

32. The modular food shield system of claim 19, further comprising a viewing panel that is flush mounted to the bracket.

33. The modular food shield system of claim 19, wherein the modular food shield system is configured as a single-side self-serve food shield.

34. The modular food shield system of claim 19, wherein the modular food shield system is configured as a double-side self-serve food shield.

35. The modular food shield system of claim 19, wherein the modular food shield system is configured as an attendant-served food shield.

* * * * *